US009281571B2

(12) United States Patent
Tinaphong et al.

(10) Patent No.: US 9,281,571 B2
(45) Date of Patent: Mar. 8, 2016

(54) ULTRA-THIN, FLEXIBLE, BROADBAND LOW PROFILE PLANAR WIRE ANTENNA

(71) Applicant: VOXX International Corporation, Hauppauge, NY (US)

(72) Inventors: Prapan Paul Tinaphong, Carmel, IN (US); Songling Zhao, Carmel, IN (US); James K. Rinehart, Indianapolis, IN (US)

(73) Assignee: VOXX International Corporation, Hauppauge, NY (US)

( * ) Notice: Subject to any disclaimer, the term of this patent is extended or adjusted under 35 U.S.C. 154(b) by 85 days.

(21) Appl. No.: 14/462,775

(22) Filed: Aug. 19, 2014

(65) Prior Publication Data

US 2015/0054705 A1 Feb. 26, 2015

Related U.S. Application Data

(60) Provisional application No. 61/867,877, filed on Aug. 20, 2013.

(51) Int. Cl.

| | |
|---|---|
| ***H01Q 1/38*** | (2006.01) |
| ***H01Q 19/10*** | (2006.01) |
| ***H01Q 9/04*** | (2006.01) |
| ***H01Q 1/40*** | (2006.01) |
| ***H01Q 5/364*** | (2015.01) |

(52) U.S. Cl.

CPC ..... *H01Q 19/10* (2013.01); *H01Q 1/40* (2013.01); *H01Q 5/364* (2015.01); *H01Q 9/0407* (2013.01)

(58) Field of Classification Search

CPC ..... H01Q 19/10; H01Q 1/40; H01Q 5/364; H01Q 9/0407

USPC ..... 343/700 MS, 815, 817, 833, 834, 893, 343/912

See application file for complete search history.

(56) References Cited

U.S. PATENT DOCUMENTS

| | | | | |
|---|---|---|---|---|
| 2,827,628 | A * | 3/1958 | Swinehart | H01Q 19/10 343/793 |
| 4,012,741 | A * | 3/1977 | Johnson | H01Q 21/065 343/700 MS |
| 5,028,932 | A * | 7/1991 | Boor | H01Q 7/02 343/723 |

(Continued)

OTHER PUBLICATIONS

The Notification of Transmittal of the International Search Report and Written Opinion of the International Searching Authority, or Declaration, dated Nov. 13, 2014; the International Search Report, dated Nov. 13, 2014; and the Written Opinion of the International Searching Authority, dated Nov. 13, 2014; issued from Applicant's corresponding PCT Application No. PCT/US2014/051631, filed on Aug. 19, 2014, each of which being from the World Intellectual Property Organization (WIPO).

*Primary Examiner* — Tho G Phan
(74) *Attorney, Agent, or Firm* — Gerald T. Bodner

(57) ABSTRACT

A broadband, low profile, ultra-thin and flexible, planar wire antenna includes an inverted triangular section and a horizontal bar section centered at the apex of the triangular section. Tab elements are provided on opposite ends of the bar section to increase the end effect of the antenna. Furthermore, 45 degree tabbed elements are joined to the top corners of the triangular section and extend in opposite directions therefrom. The tabbed elements added to the triangular section and to the bar section increase the overall electrical length of the antenna to simulate a physically larger size antenna.

20 Claims, 24 Drawing Sheets

(56) References Cited

U.S. PATENT DOCUMENTS

| | | | | |
|---|---|---|---|---|
| 6,429,828 | B1 | 8/2002 | Tinaphong et al. | 343/824 |
| 7,091,909 | B2 * | 8/2006 | Nakano | H01Q 1/40 343/700 MS |
| 7,439,926 | B2 * | 10/2008 | Mikami | H01Q 7/00 343/789 |
| 8,269,672 | B2 | 9/2012 | Tinaphong et al. | 343/700 MS |
| 2002/0053994 | A1 * | 5/2002 | McCorkle | H01Q 1/38 343/824 |
| 2010/0289716 | A1 | 11/2010 | Lenzi et al. | 343/793 |
| 2011/0291907 | A1 | 12/2011 | Puzella et al. | 343/816 |
| 2013/0188812 | A1 | 7/2013 | Tinaphong | 381/315 |

* cited by examiner

ULTRA-THIN, FLEXIBLE, BROADBAND LOW PROFILE PLANAR WIRE ANTENNA

CROSS-REFERENCE TO RELATED APPLICATIONS

This application is related to U.S. Provisional Application Ser. No. 61/867,877, which was filed on Aug. 20, 2013, and is entitled "Broadband Low Profile Planar Wire Antenna", the disclosure of which is incorporated herein by reference and on which priority is hereby claimed.

BACKGROUND OF THE INVENTION

1. Field of the Invention

The present invention relates to broadband antennas for receiving digital broadcast television signals, and more specifically relates to broadband, low profile, planar antennas for television signal reception.

2. Description of the Prior Art

Many antennas that are suitable for receiving digital television signal transmissions off-air (i.e., broadcast over the air) are often times relatively large and unwieldy and occupy significant space when mounted on a wall in an owner's premises. Another problem with such television antennas is that they do not provide good performance over the entire VHF and UHF television bands.

OBJECTS AND SUMMARY OF THE INVENTION

It is an object of the present invention to provide a broadband, low profile, planar wire antenna.

It is another object of the present invention to provide a broadband antenna which is suitable for digital television signal reception off-air.

It is yet another object of the present invention to provide a low profile, planar wire antenna that provides good performance for the VHF and UHF television bands and is relatively compact, fitting on a 12 inch×12 inch thin film substrate.

In accordance with one form of the present invention, a broadband, low profile, omni-directional (at least in the horizontal plane), planar wire antenna includes antenna elements which are fabricated with conductive silver ink and plated on a thin film, flexible substrate. The antenna includes an inverted triangular section and a horizontal bar section centered at the apex of the triangular section. Tab elements are provided on opposite ends of the bar section to increase the end effect of the antenna. Furthermore, 45 degree tab elements are joined to the top corners of the triangular section and extend in opposite directions therefrom. The tab elements added to the triangular section and to the bar section increase the overall electrical length of the antenna to simulate a physically larger size antenna.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1A:
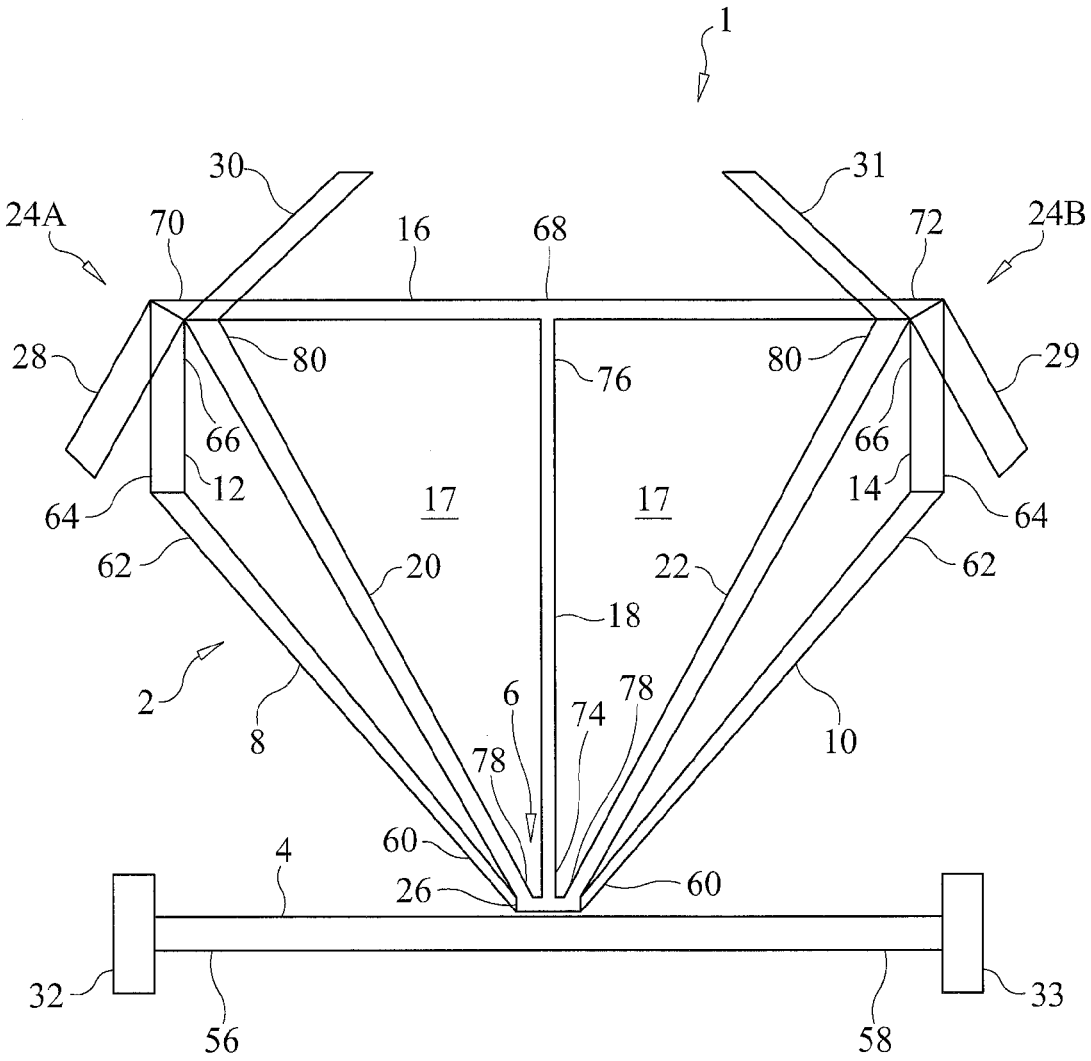
FIG. 1A is a front view of a broadband, low profile, planar wire antenna formed in accordance with the present invention, and illustrating the dimensions and angles of the antenna elements.
Figure 1B:
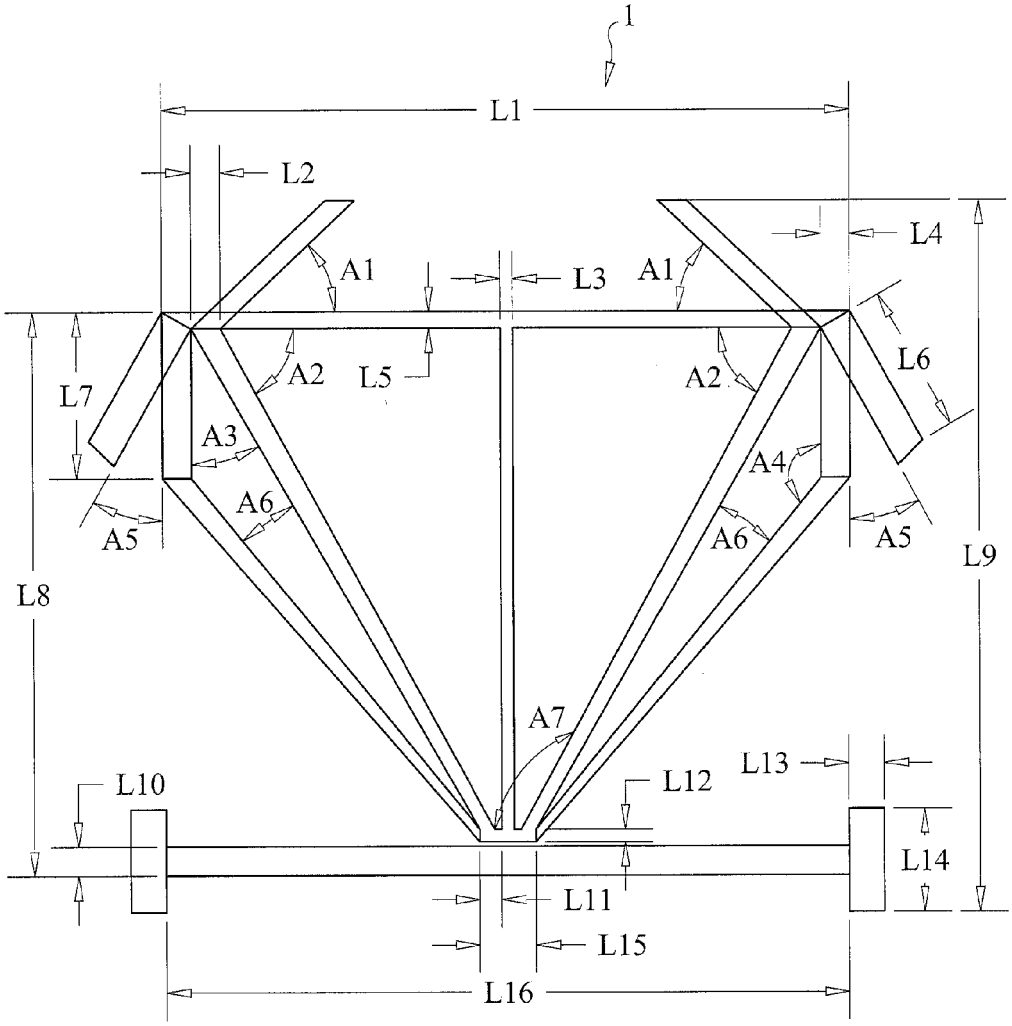
FIG. 1B is a front view of the broadband, low profile, planar wire antenna of the present invention shown in FIG. 1A, and illustrating the dimensions and angles of the antenna elements.
Figure 2A:
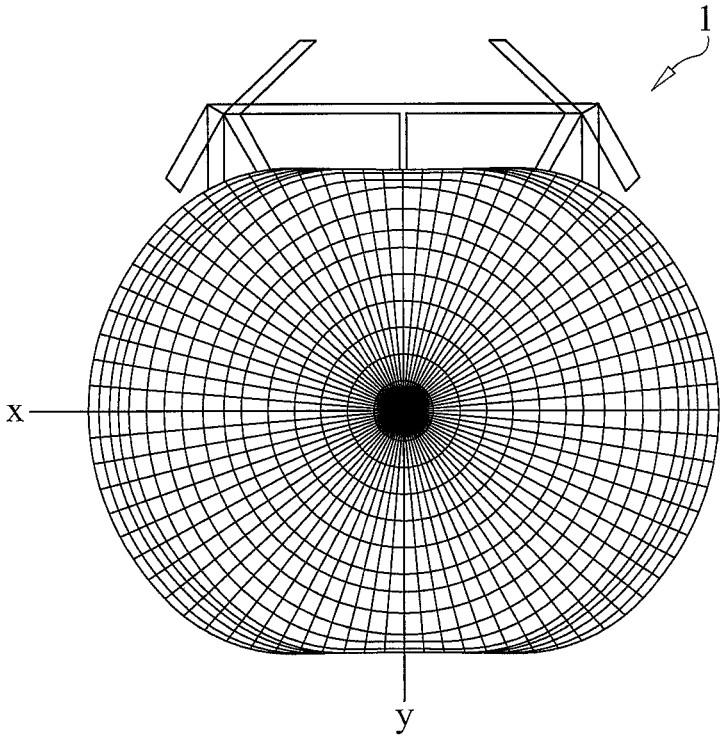
FIGS. 2A, 2B and 2C are different simulation graphs and charts of antenna gain for the planar antenna of the present invention, at a frequency of 180 MHz.
Figure 2B:
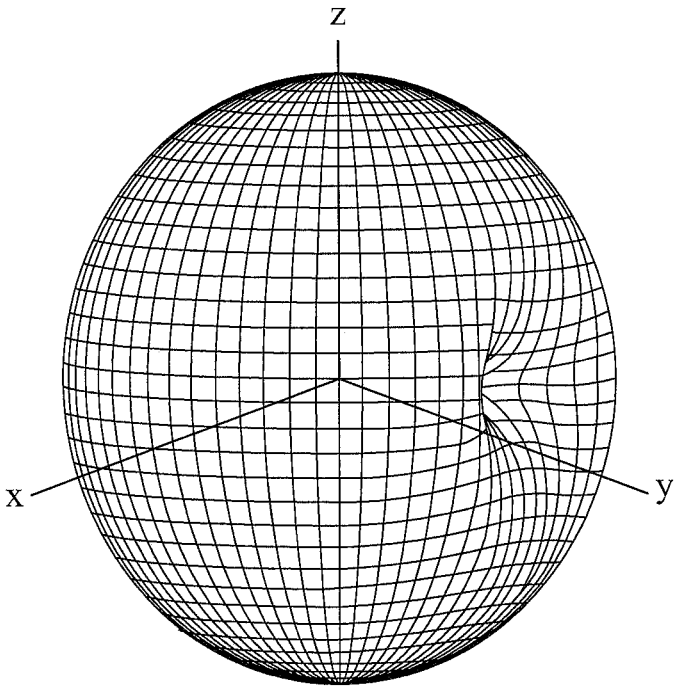
Figure 2C:
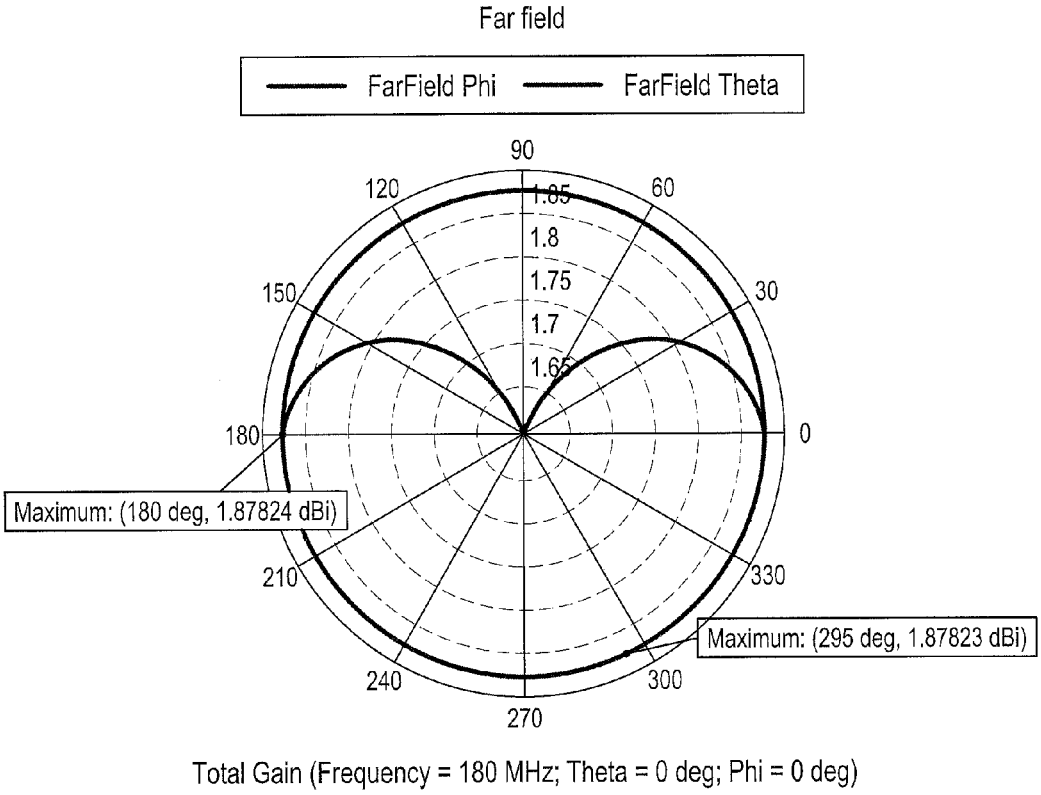
Figure 3A:
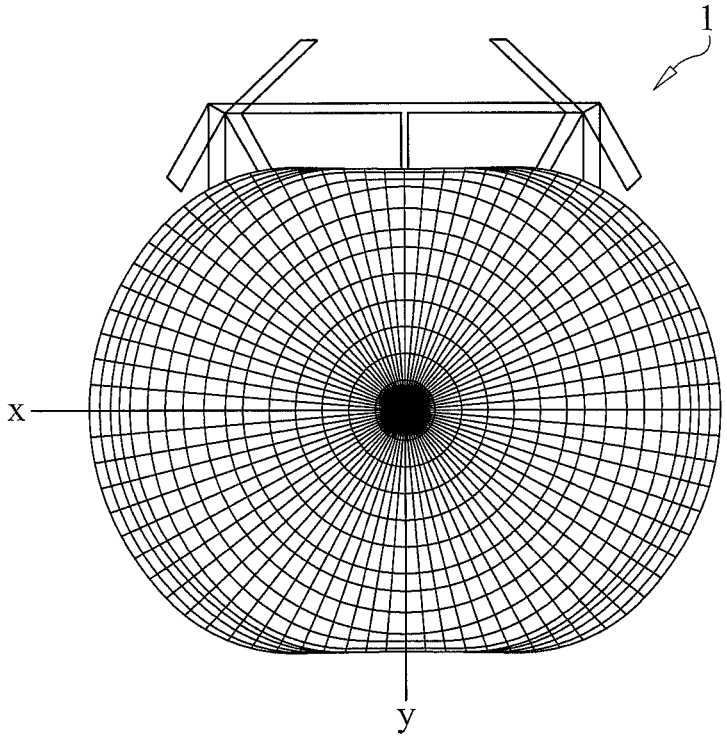
FIGS. 3A, 3B and 3C are different simulation graphs and charts of antenna gain for the planar antenna of the present invention, at a frequency of 550 MHz.
Figure 3B:
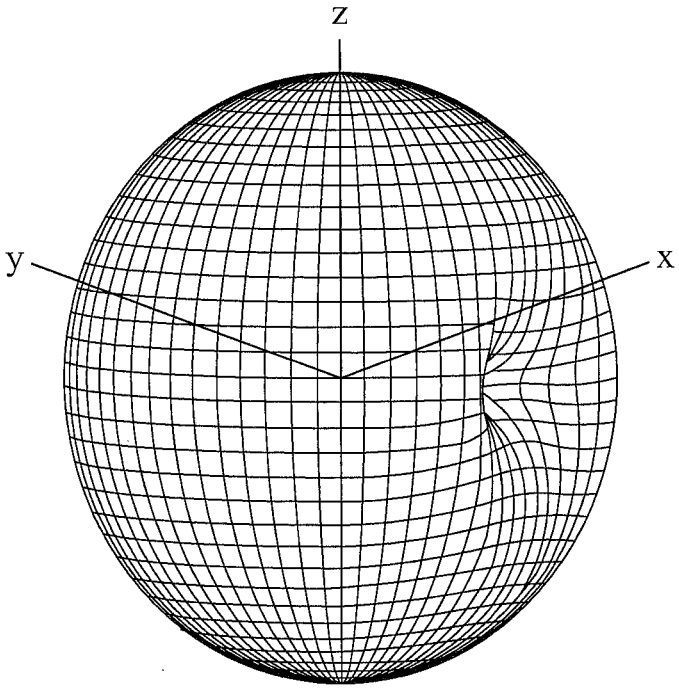
Figure 3C:
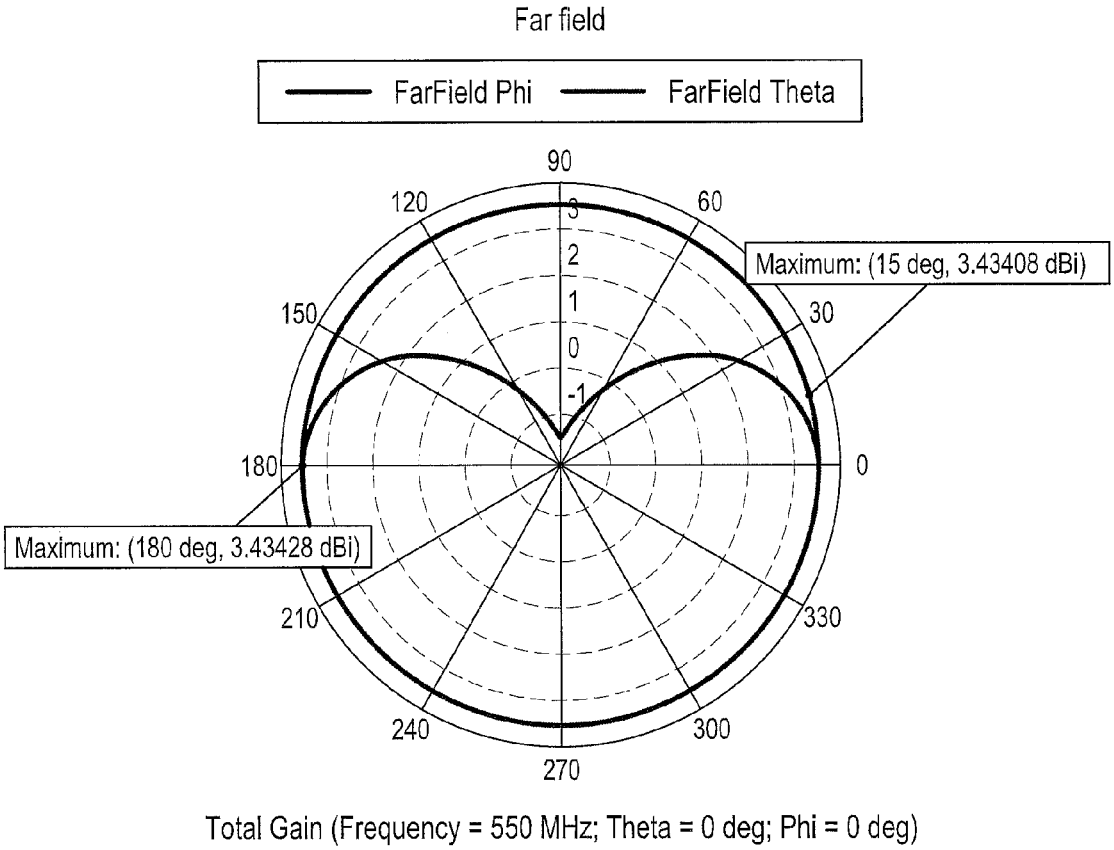
Figure 4A:
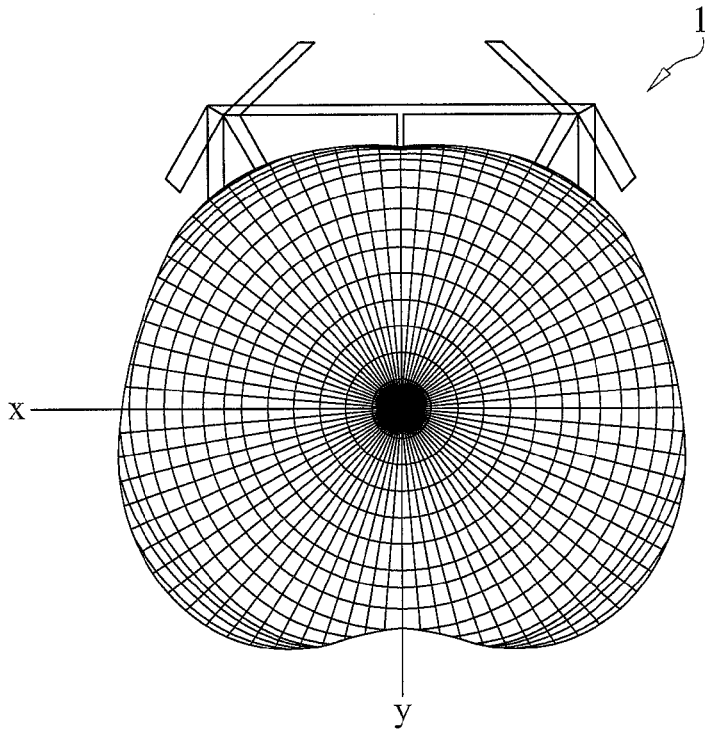
FIGS. 4A, 4B and 4C are different simulation graphs and charts of antenna gain for the planar antenna of the present invention, at a frequency of 625 MHz.
Figure 4B:
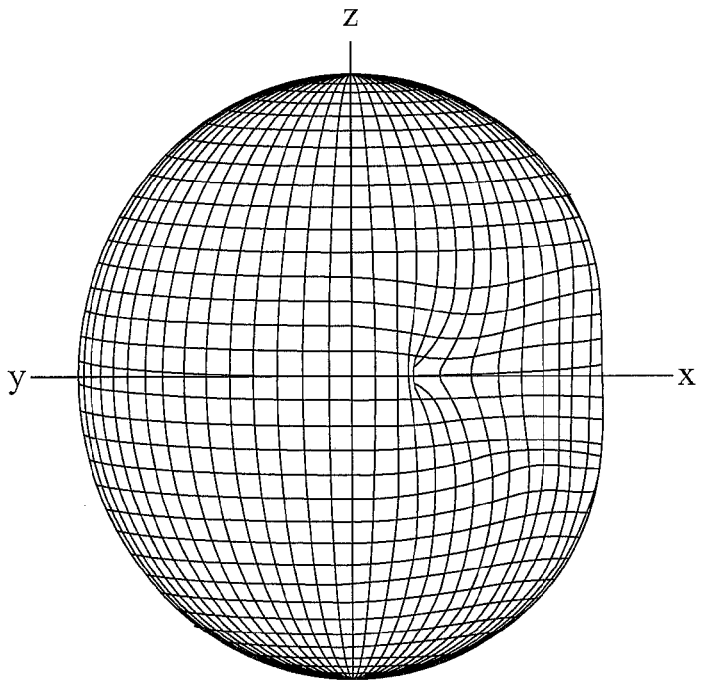
Figure 4C:
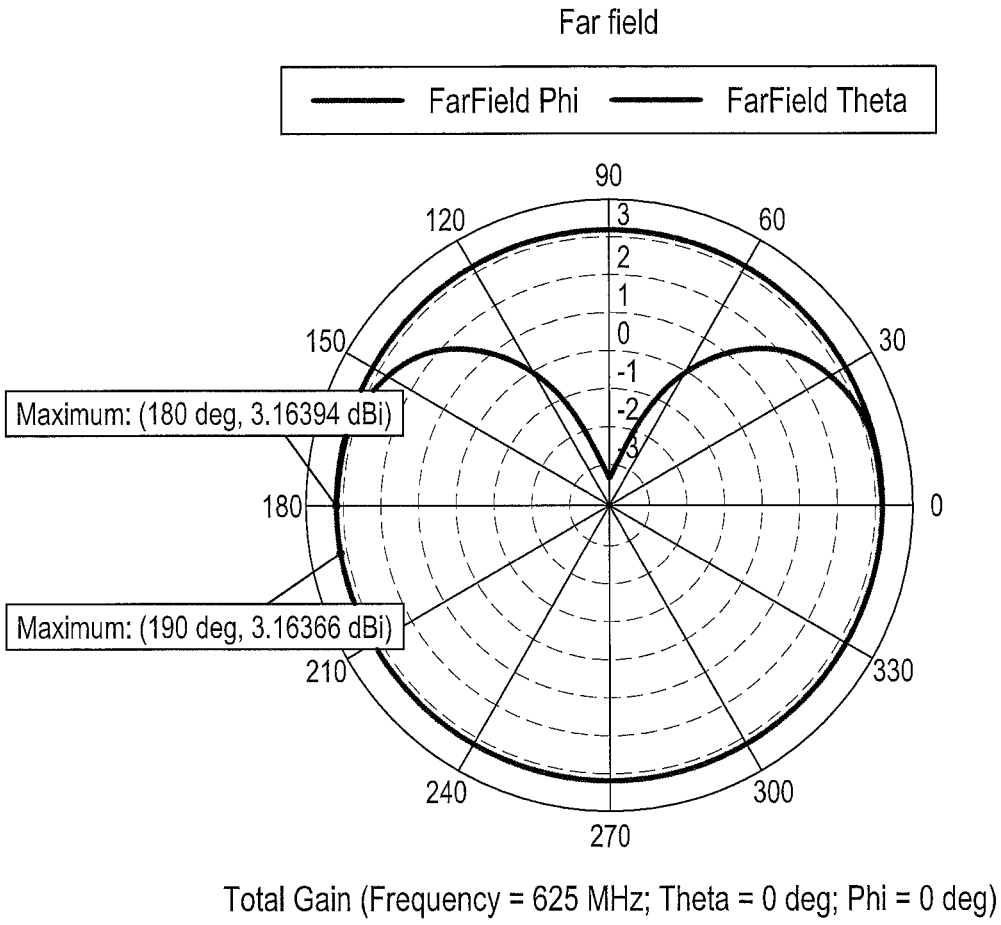
Figure 5A:
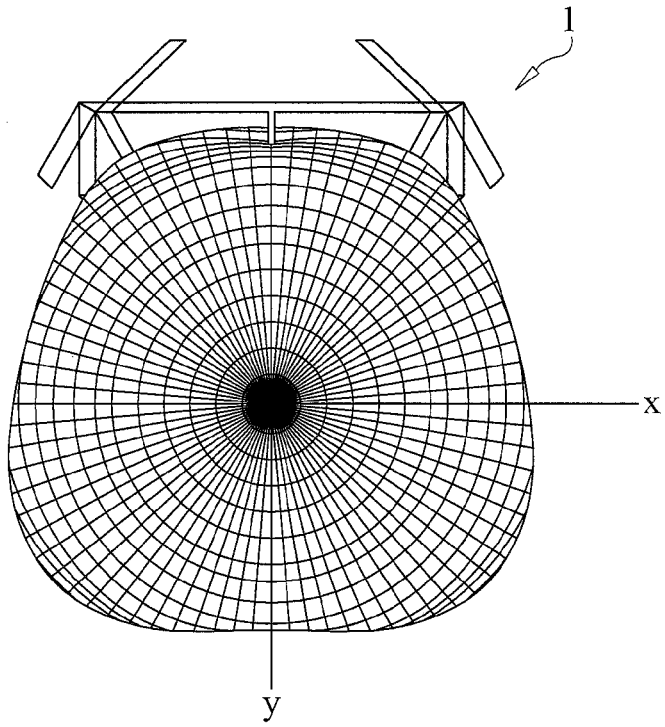
FIGS. 5A, 5B and 5C are different simulation graphs and charts of antenna gain for the planar antenna of the present invention, at a frequency of 700 MHz.
Figure 5B:
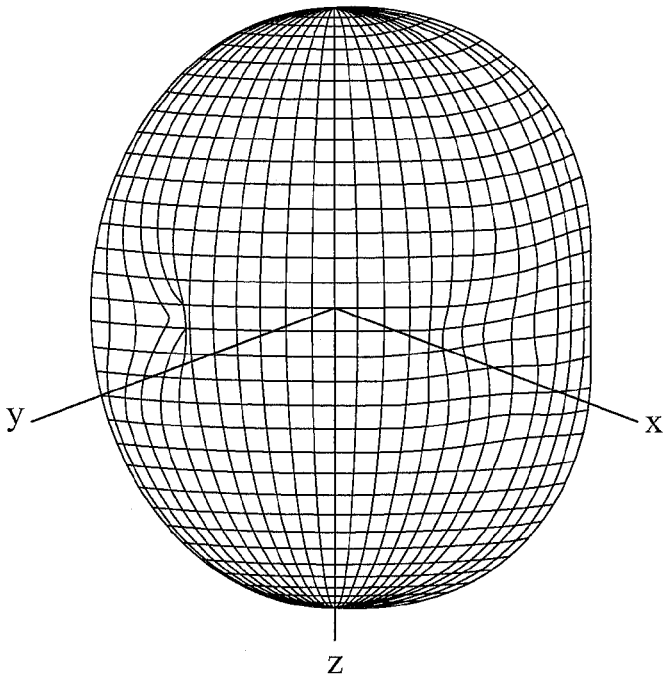
Figure 5C:
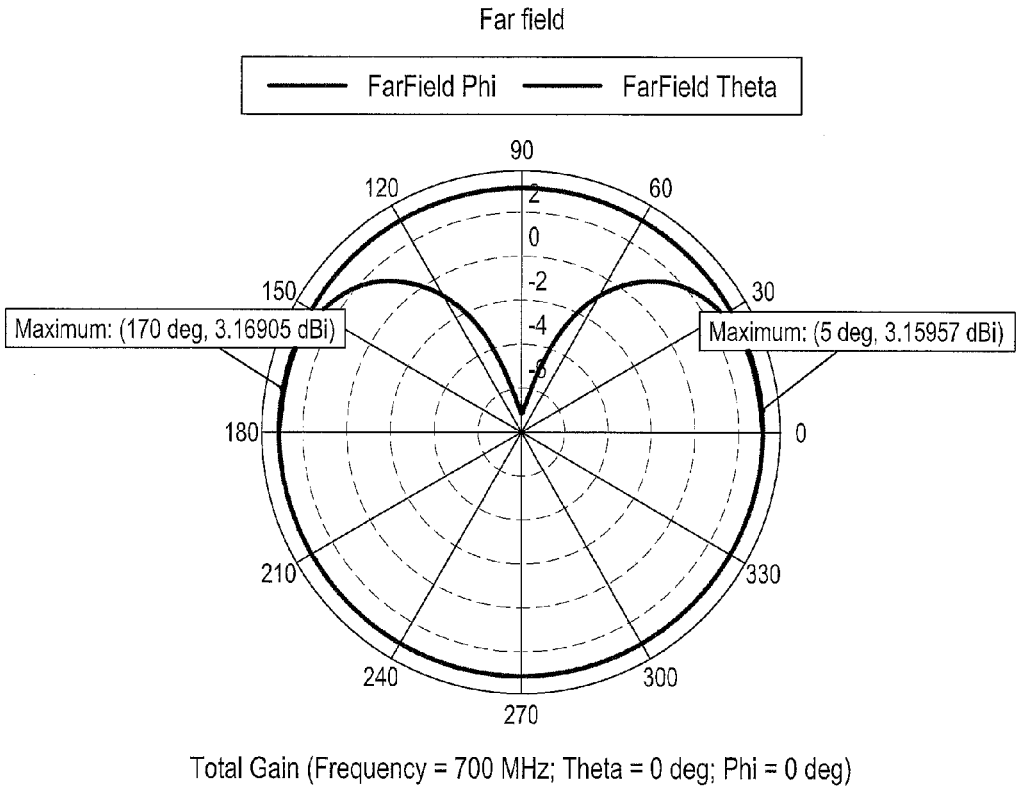

A broadband, low profile, planar wire antenna 1 constructed in accordance with the present invention is shown in FIGS. 1A and 1B of the drawings, and simulation graphs and charts of the antenna's frequency response, at selected frequencies, are shown in FIGS. 2A-5C.

The antenna elements are preferably fabricated with conductive silver ink and plated on a thin film which has been used as a media substrate material. The thin film material is preferably one of Kapton® HPP-ST film or polycarbonate (PC) film or material. Kapton® HPP-ST is a two-sided treated polyimide film manufactured by DuPont Corporation. The specifications of Kapton® HPP-ST film may be found under H-38479 in Bulletin GS-96-7 of DuPont Corporation. A data sheet with the general properties of PC sheet or film may be found on the website of Jin-Taiwan Enterprise Co., Ltd., at www.jin-taiwan.com.tw.

The media substrate on which the antenna elements are plated may also be any FR4 or G10 fiberglass, single side, printed circuit board material with a one ounce copper cladding as a preferred minimum.

As can be seen from FIGS. 1A and 1B of the drawings, the broadband, low profile, planar wire antenna 1 exhibits some structural characteristics of a planar discone antenna. The antenna 1 includes an inverted generally triangular section 2, and a bar section 4, the center of the bar section 4 being positioned in proximity to the apex 6 of the triangular section 2.

Even more specifically, the triangular section 2 is formed with a plurality of segments (antenna elements) extending angularly from the apex 6 of the triangular section 2.

More particularly, first and second outer segments 8, 10 define sloping sides of the triangular section 2. The proximate ends of the first and second outer segments 8, 10 are joined to the apex 6 of the triangular section 2, and the axially opposite distal ends of each of the first and second outer segments 8, 10 are respectively joined to parallelly disposed first and second side segments 12, 14. The first and second side segments 12, 14 are perpendicularly joined to the opposite ends of a base segment 16 of the triangular section 2. The first and second side segments 12, 14, the first and second outer segments 8, 10 and the base segment 16 together define the inverted triangular section 2 with an interior area 17.

A center segment 18 of the triangular section 2 extends from the apex 6 to the center of the base segment 16. At least first and second interior angled segments 20, 22 extend from the apex 6 to the top corners 24A, 24B of the triangular section 2 defined by the intersection of the base segment 16 and the first and second side segments 12, 14, the at least first interior angled segment 20 being situated between the first outer segment 8 and the center segment 18, and the at least second interior angled segment 20 being situated between the second outer segment 10 and the center segment 18.

The apex 6 of the triangular section 2 is defined by a relatively short cross segment 26 from which the first and second outer segments 8, 10 and other interior segments 20, 22 and center segment 18 of the triangular section 2 extend. It should be understood that the segments described herein refer to and function as antenna elements.

At each top corner 24A, 24B of the triangular section 2, that is, excluding the apex 6, which corners 24A, 24B are defined by the juncture of the first and second side segments 12, 14 and the base segment 16, there extends first and second tab elements 28, 29 extending respectively from the first and second side segments 12, 14 angularly in an outwardly downward direction, and third and fourth tab elements 30, 31 respectively extending in a generally opposite direction to the first and second tab elements 28, 29 and in an outwardly, angularly upward direction. The first and second tab elements 28, 29 and the third and fourth tab elements 30, 31 situated at the top corners 24A, 24B of the triangular section 2 of the antenna 1 help increase the effective electrical length of the antenna 1.

More specifically, and preferably, the first and second tab elements 28, 29 are integrally formed extensions of the respective first and second side segments 12, 14. The tab elements 28, 29 which are preferably extended portions of the first and second side segments 12, 14, are folded angularly over their respective side segments 12, 14 from which they extend and define an acute interior angle A5 therewith, the preferred angle A5 being specified in Table I. The first and second tab elements 28, 29 extend angularly from the top corners 24 of the antenna 1 defined by the junctions of the base segment 16 and the first and second side segments 12, 14.

Similarly, and also preferably, the third and fourth tab elements 30, 31 are integrally formed extensions of the respective first and second interior angled segments 20, 22, and respectively extend angularly from the distal ends of the first and second interior angled segments 20, 22 past the top edge of the base segment 16. The third and fourth tab elements 30, 31 define an acute interior angle A1 with the base element 16, the preferred angle A1 being specified in Table I.

The lower bar section 4 also includes first and second end tab elements 32, 33 joined at their centers perpendicularly to the opposite axial ends of the bar section 4. The first and second end tab elements 32, 33 are added to the ends of the bar section 4 to increase the end effect (that is, the end tab elements 32, 33 allow the bar section 4 to be physically shortened and still provide effective resonance).

The feed points (signal and ground) for the antenna 1 are respectively at the apex 6 of the triangular section 2 and the center of the lower bar section 4. More specifically, the center conductor of the antenna signal cable 42 is electrically connected to the center of cross segment 26 defining the apex 6 of the inverted triangular section 2, and the ground shield of the signal cable 42 is electrically connected to the center of the bar section 4, which acts as a ground plane for the antenna.

The first through fourth tab elements 28-31 situated at the top corners 24A, 24B of the triangular section 2, and the first and second end tab elements 32, 33 situated at opposite axial ends of the bar section 4, and the unique shape of the triangular section 2, allow the antenna 1 of the present invention to perform well over the VHF and UHF television bands for receiving ATSC (Advanced Television Systems Committee) digital television off-air (broadcast over the air) transmission signals, and furthermore provide the antenna 1 with the electrical characteristics and electrical length similar to a physically larger size antenna.

Even more specifically, the unique antenna design pattern of conductive silver ink plated on the special media substrate, such as Kapton® or PC film material provides a compact antenna which can be constructed to fit on a 12 inch×12 inch thin film sheet and still provide good performance for both VHF and UHF television reception bands. The frequency response of this antenna at selected frequencies may be seen from the gain plots and charts shown in FIGS. 2A-2C for 180 MHz, FIGS. 3A-3C for 550 MHz, FIGS. 4A-4C for 625 MHz and FIGS. 5A-5C for 700 MHz.

Referring again to FIG. 1B of the drawings, the dimensions and angles of the antenna element segments and tab and end elements of the triangular section and the bar section are labeled L1-L16 and A1-A7, respectively, and the particular length and angles of each of the antenna elements are set forth in Table I below:

TABLE I

| Preferred Lengths and Angles of the Antenna Segments of the Antenna Shown in FIGS. 1A and 1B |
|---|
| L1 = 10.11 inches |
| L2 = 0.43 inches |
| L3 = 0.19 inches |
| L4 = 0.41 inches |
| L5 = 0.25 inches |
| L6 = 2.18 inches |
| L7 = 2.43 inches |
| L8 = 8.24 inches |
| L9 = 10.6 inches |
| L10 = 0.5 inches |
| L11 = 0.21 inches |
| L12 = 0.17 inches |
| L13 = 0.5 inches |
| L14 = 1.5 inches |
| L15 = 0.78 inches |
| L16 = 10.11 inches |
| A1 = 42.52 degrees |
| A2 = 61.51 degrees |
| A3 = 29.91 degrees |
| A4 = 141.29 degrees |
| A5 = 29.11 degrees |
| A6 = 9.36 degrees |
| A7 = 118.58 degrees |

With the low profile, planar wire antenna 1 of the present invention mounted on a thin film material, the antenna is ultra-thin and flexible and easy to install behind a TV panel or just hanging on a wall. Its flexible design and small size (12 inches×12 inches) provide an unobtrusive and easy installation of the antenna. The size of the antenna has been reduced in order to optimize both bandwidth response and gain for effective over-the-air digital television signal reception.

The broadband, low profile, planar wire antenna of the present invention uses a unique metal or conductive element pattern to increase the electrical length/size of the triangular section and bar section. This allows the antenna to have the bandwidth performance of a larger sized antenna, but with an actual smaller physical size.

Figure 6:
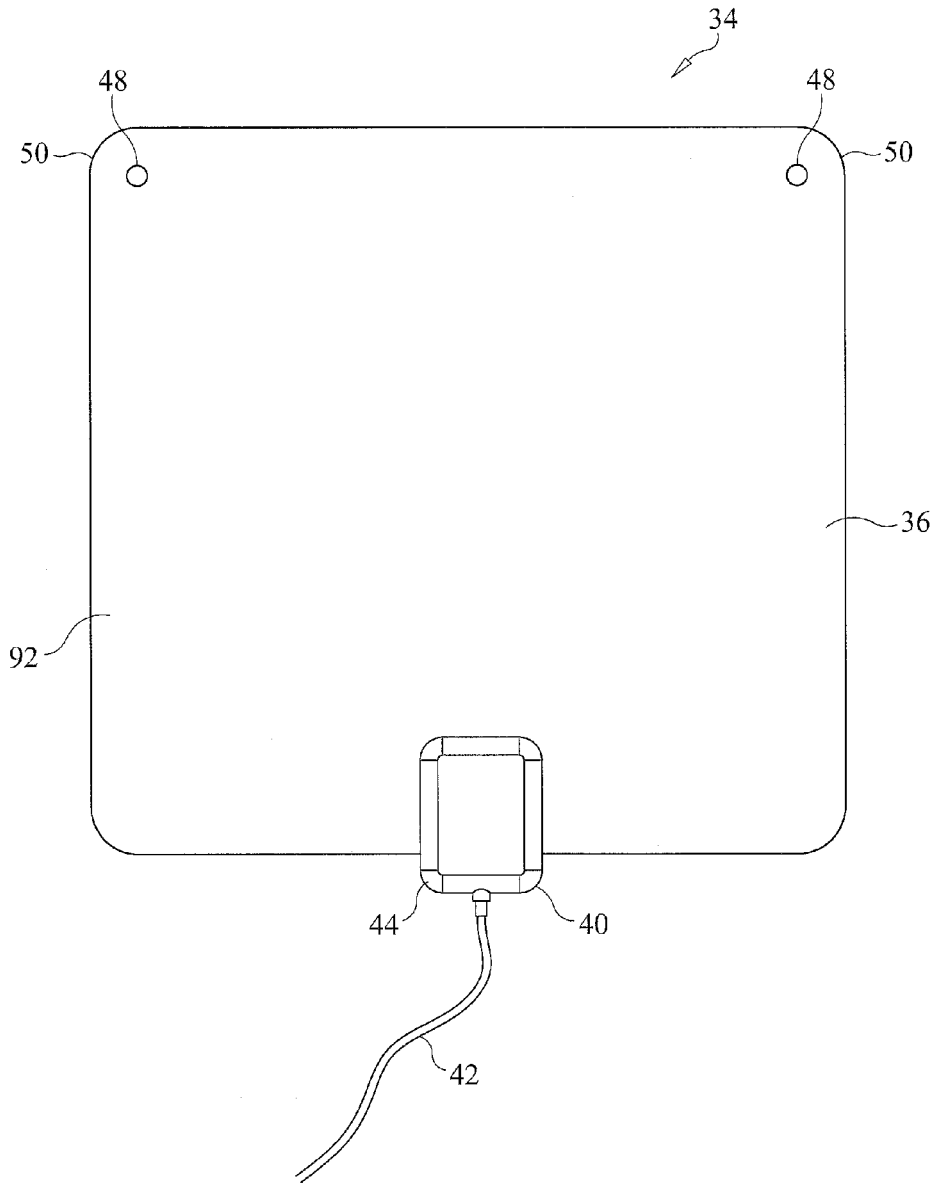
FIG. 6 is a front elevational view of an antenna product formed in accordance with the present invention and incorporating the antenna shown in FIG. 1.
Figure 7:
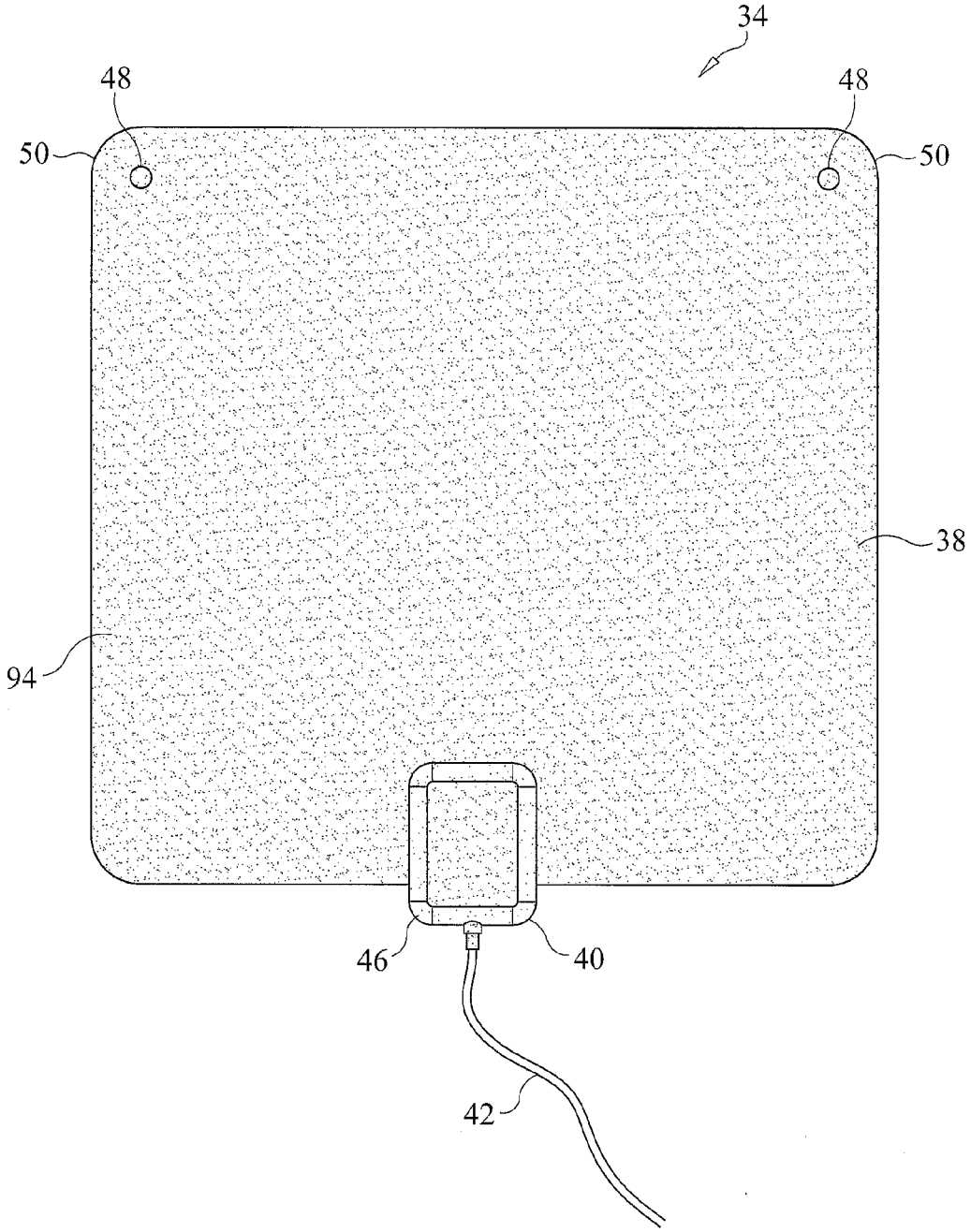
FIG. 7 is a rear elevational view of the antenna product of the present invention shown in FIG. 6.
Figure 8:
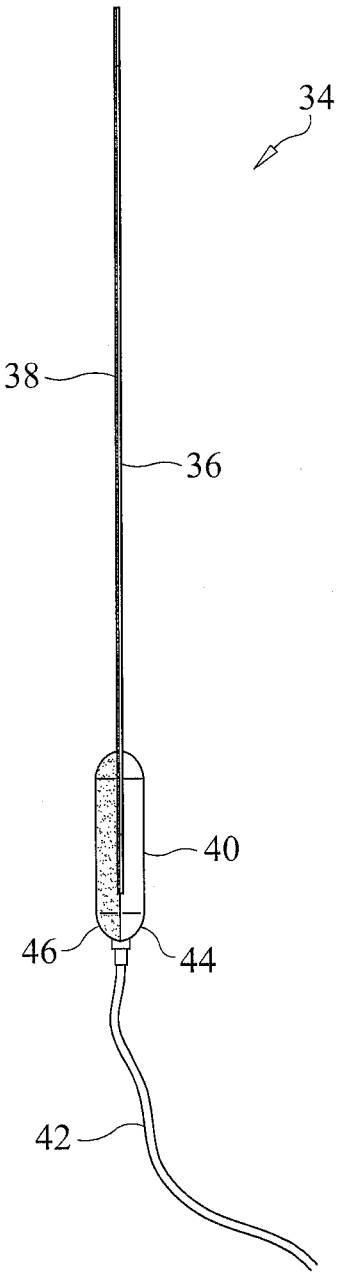
FIG. 8 is a side elevational view of the antenna product of the present invention shown in FIGS. 6 and 7.
Figure 9:
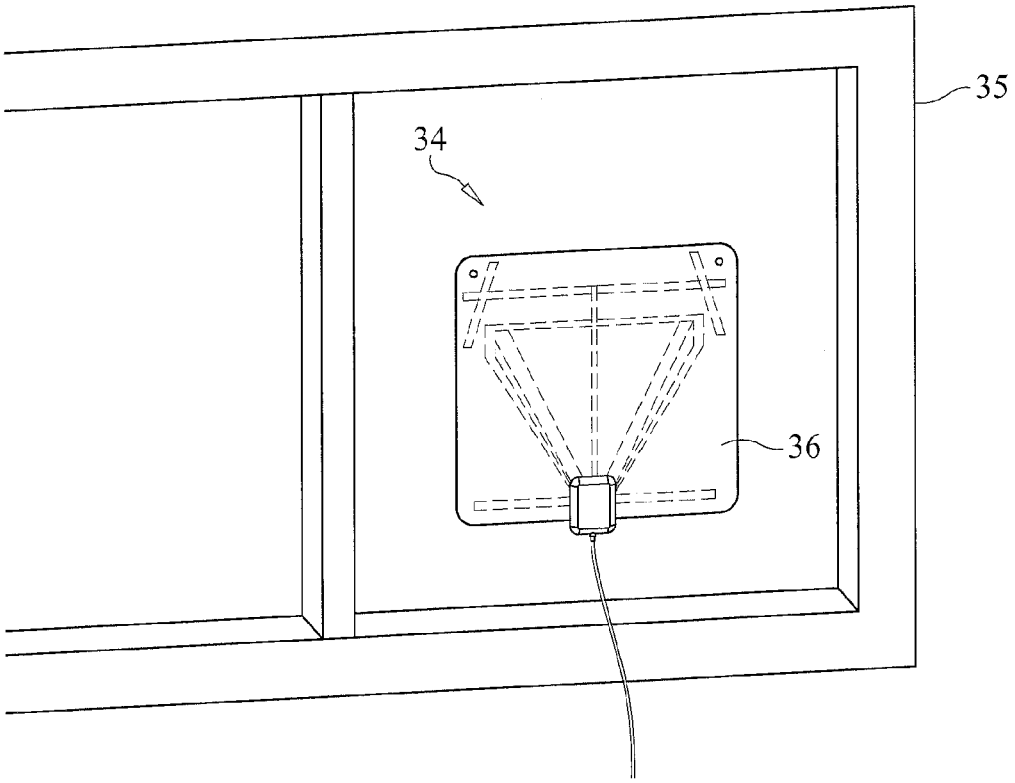
FIG. 9 is a perspective view of the antenna product of the present invention shown mounted on a window of a residence.
Figure 10:
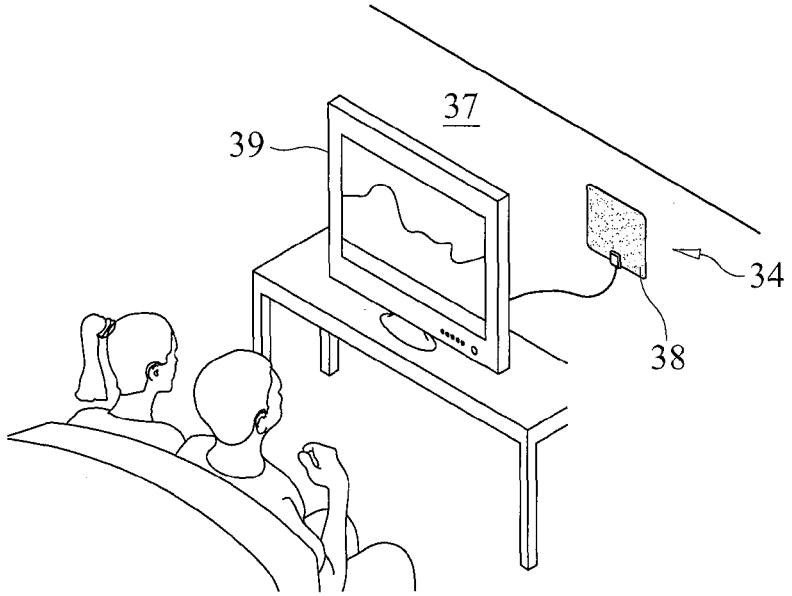
FIG. 10 is a perspective view of the antenna product of the present invention shown mounted on a wall of a residence.

FIGS. 6, 7 and 8 are respectively a front elevational view, a rear elevational view and a side elevational view of the finished antenna product, or assembly, 34 incorporating the antenna 1 described previously. More specifically, the antenna 1 shown in FIG. 1 is sandwiched between front and rear protective covering layers 36, 38 formed of a polyimide or polycarbonate film, at least one of which may also serve as a substrate which supports the interiorly-disposed antenna 1 and on which the antenna elements are preferably inked or etched. The front covering layer 36 and rear covering layer 38 are preferably formed with contrasting colors from each other, for example, white for the front covering layer 36 and black for the rear covering layer 38, or vice versa. The different shades of color, that is, light and dark, of the front covering layer 36 and the rear covering layer 38 help the antenna product 34 blend in with different decors in a residence in which the antenna product 34 is used. For example, if the antenna product 34 is mounted on the glass of a window 35, the frame and sash of which are oftentimes white in color, the antenna product 34 may be oriented such that the light or white-colored front or rear covering layer 36, 38 is facing inwardly of the interior area of the residence, such as shown in FIG. 9 of the drawings, so that the light or white-colored covering layer 36, 38 blends in with the windows and trim of the residence. Alternatively, and for example, if the antenna product 34 is mounted to a wall 37 in proximity to a flat screen television 39, which usually has a black or dark-colored housing, the antenna product 34 may be oriented such that the dark or black-colored front or rear covering layer 36, 38 is facing inwardly of the interior area of the residence, such as shown in FIG. 10 of the drawings, so that the dark or black-colored covering layer 36, 38 blends in with the television or, perhaps, furniture of the residence.

In an alternative embodiment of the antenna product, or assembly, 34 of the present invention, either the front covering layer 36 or the rear covering layer 38 is a polyimide or polycarbonate film and acts as a substrate to support the elements of the antenna 1, the antenna elements being inked or etched on, or adhered to, the inside surface of the supporting covering layer 36, 38. The other layer of the first and second covering layers 36, 38, in this alternative embodiment, need not be a film material, but rather may be a layer of paint, preferably contrasting in color to the opposite supporting layer 36, 38, applied over the antenna 1 and the inside surface of the antenna supporting layer 36, 38, the paint layer covering the exposed side of the antenna 1 supported on its opposite side by the other covering layer 36, 38. Preferably, the dark or black side covering layer 36, 38 is the polyimide or polycarbonate film which supports the antenna 1 and its elements, and the light or white side covering layer 36, 38 is a layer of paint.

Figure 11:
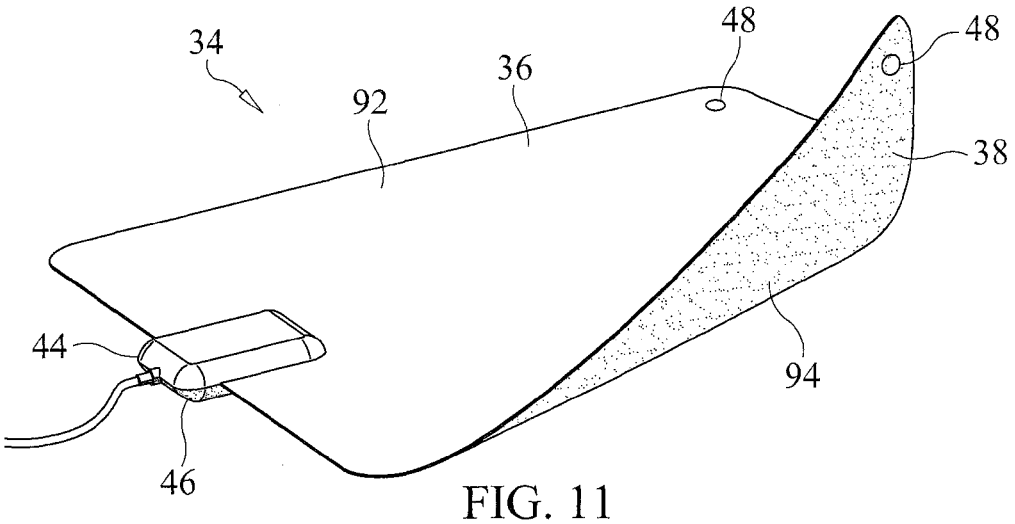
FIG. 11 is a perspective view of the antenna product of the present invention and illustrating the flexibility and thinness of the antenna product.

FIG. 11 is a perspective view of the finished antenna product 34 of the present invention, and illustrates the ultra-thin, flexible nature of the antenna product (the antenna product 34 is shown in FIG. 11 with one portion thereof flexed out of the plane in which the rest of the antenna product 34 resides). The side view of the antenna product 34 shown in FIG. 8 also illustrates the ultra-thinness of the antenna product 34 incorporating the antenna 1 of the present invention. The thickness of the antenna assembly 34, measured from the outer surface of the front covering layer 36 to the opposite outer surface of the rear covering layer 38, is preferably less than about one millimeter, and even more preferably is only about 0.47 millimeters. In the alternative embodiment of the antenna assembly 34 having a supporting film covering layer and an opposite covering layer of paint, the supporting film has a thickness of about 0.44 millimeters.

A housing 40 covers the feed point and the connection of one end of the antenna cable 42 to the antenna 1 at the apex 6 thereof. The housing 40 includes two mating front and rear sections 44, 46, the front section 44 being disposed on and mounted to a portion of the front covering layer 36, or the antenna supporting film, and the rear section 46, facing in an opposite direction to the front section 44, being disposed on and mounted to a portion of the rear covering layer 38, or also to the antenna supporting film on the painted side thereof. Preferably, the front section 44 of the antenna cable connection housing 40 has the same color as that of the front covering layer 36, and the rear section 46 of the housing 40 has the same color as that of the rear covering layer 38, so that the antenna cable connection housing 40 will also blend in with the décor of the residence in which the antenna product 34 is mounted. As is evident from the above description, the antenna product 34 of the present invention may be oriented with either covering layer 36, 38 facing the exterior of the housing, and further may be oriented at any angle through 360 degrees, and still provide good reception of broadcast over-the-air digital television signals for viewing on a television receiver.

The antenna product 34 of the present invention may have formed through the thickness thereof (i.e., through the front and rear covering layers 36, 38) openings 48, preferably positioned in the opposite upper corners 50 of the antenna product 34, for the user to mount the antenna product 34 to a supporting structure, such as a vertical wall in the user's residence, using fasteners (e.g., nails, screws, hooks or the like) placed through the openings 48. Alternatively, because the antenna product 34 is so light (it weighs less than about two ounces, without the antenna cable 42) and is paper thin, it may be mounted to a supporting surface (e.g., wall or window) using adhesive tape.

Figure 12:
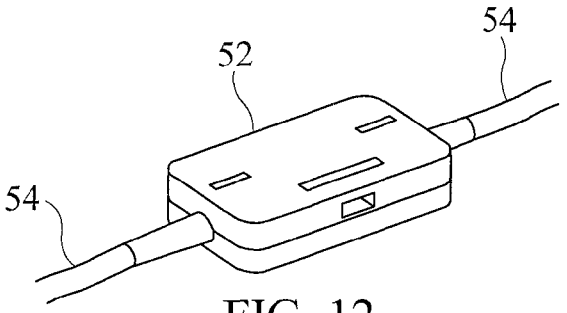
FIG. 12 is a perspective view of a pre-amplifier device used with the antenna product of the present invention.

Also, as shown in FIG. 12 of the drawings, the antenna product 34 may include a pre-amplifier circuit situated within a housing 52, the pre-amplifier circuit being connected to antenna cables 54 preferably extending from opposite sides of the amplifier housing 52 and connectable to the antenna cable 42 of the antenna product 34, for amplifying the broadcast television signals received by the antenna 1 prior to providing the signals to the signal input port of the television receiver to which the antenna product 34 is connected (that is, by connecting the opposite free axial end of the antenna cable 42 to the signal input port of the television receiver).

Figure 13A:
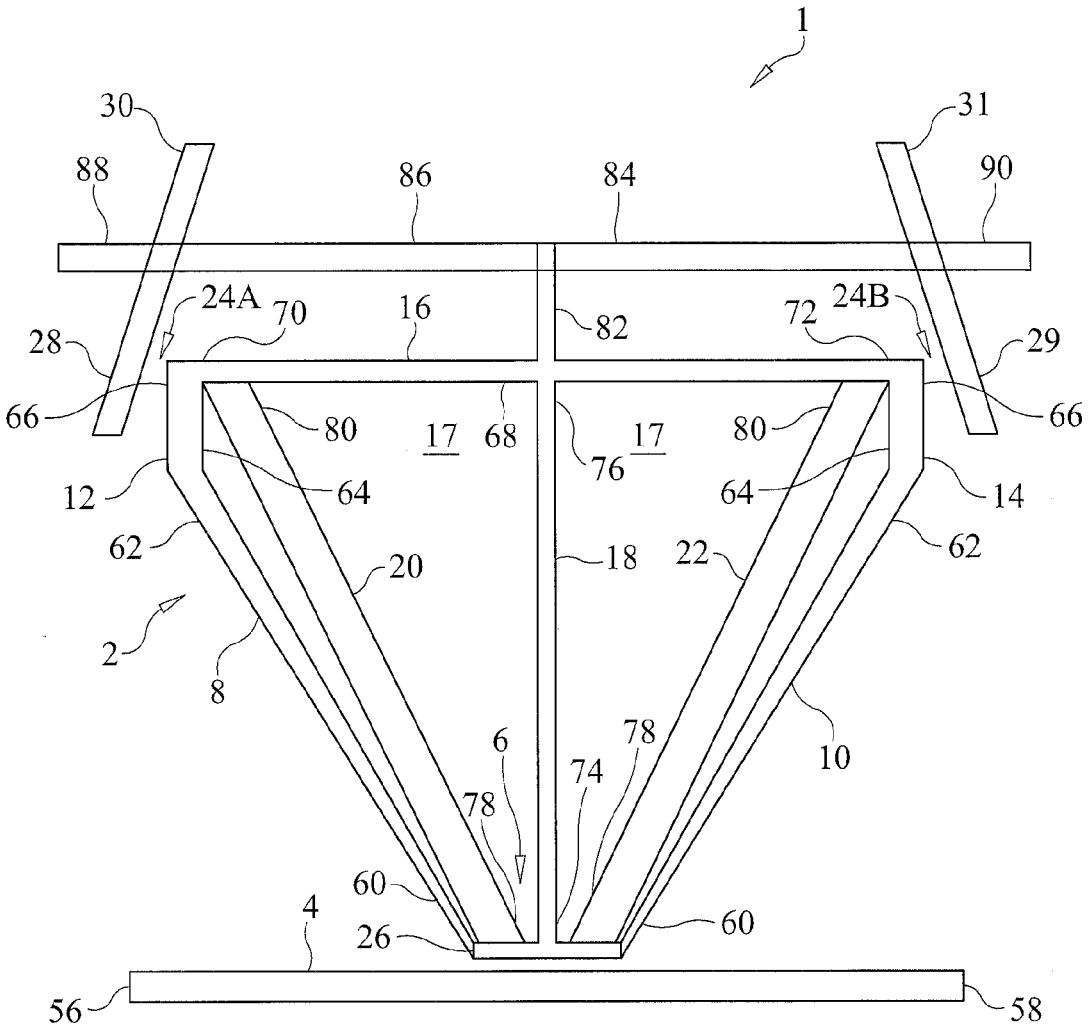
FIG. 13A is a front view of another embodiment of the broadband, low profile, planar wire antenna formed in accordance with the present invention, and illustrating the dimensions and angles of the antenna elements of this alternative embodiment.
Figure 13B:
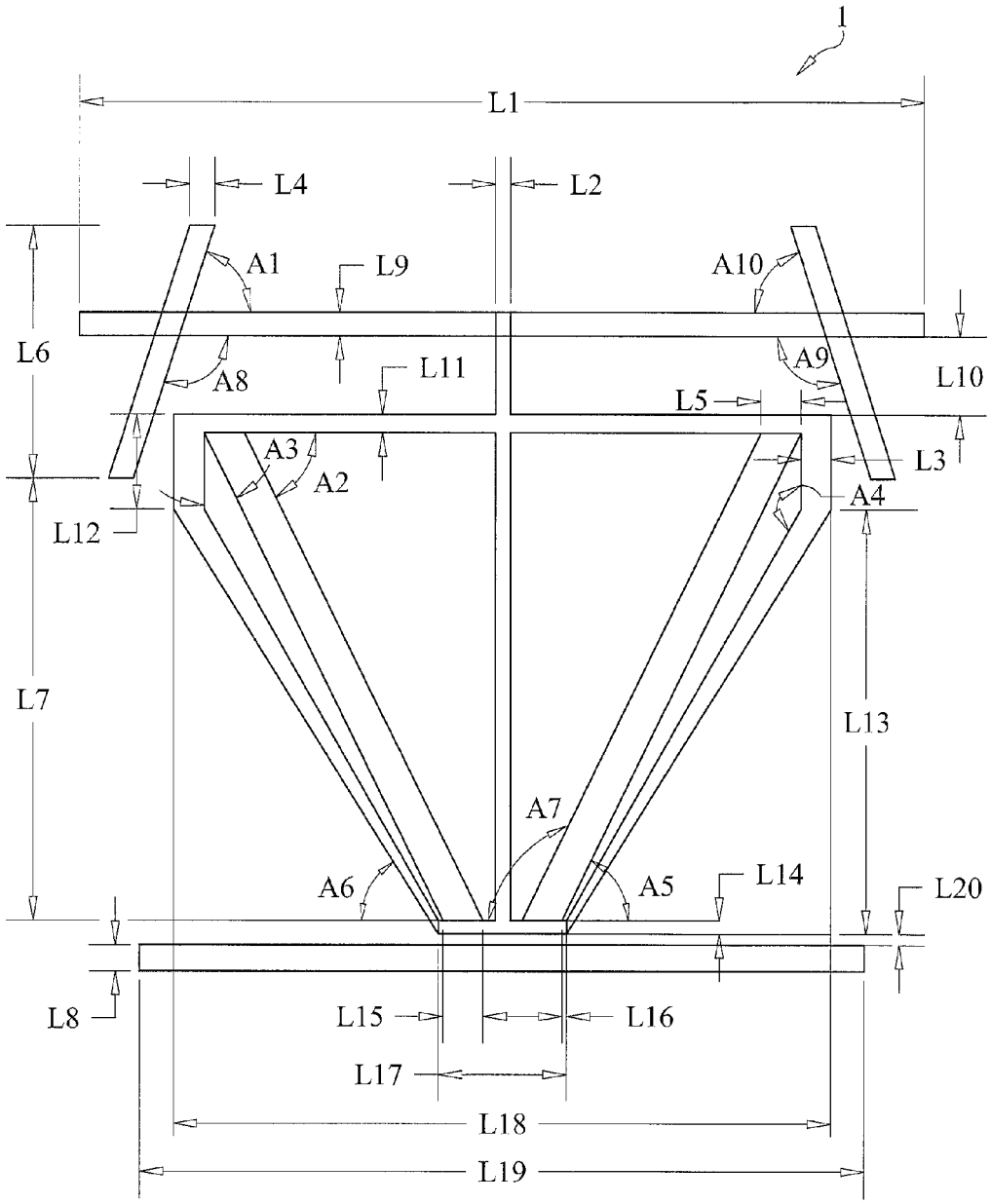
FIG. 13B is a front view of the broadband, low profile, planar wire antenna of the present invention shown in FIG. 13A, and illustrating the dimensions and angles of the antenna elements of this alternative embodiment.
Figure 14:
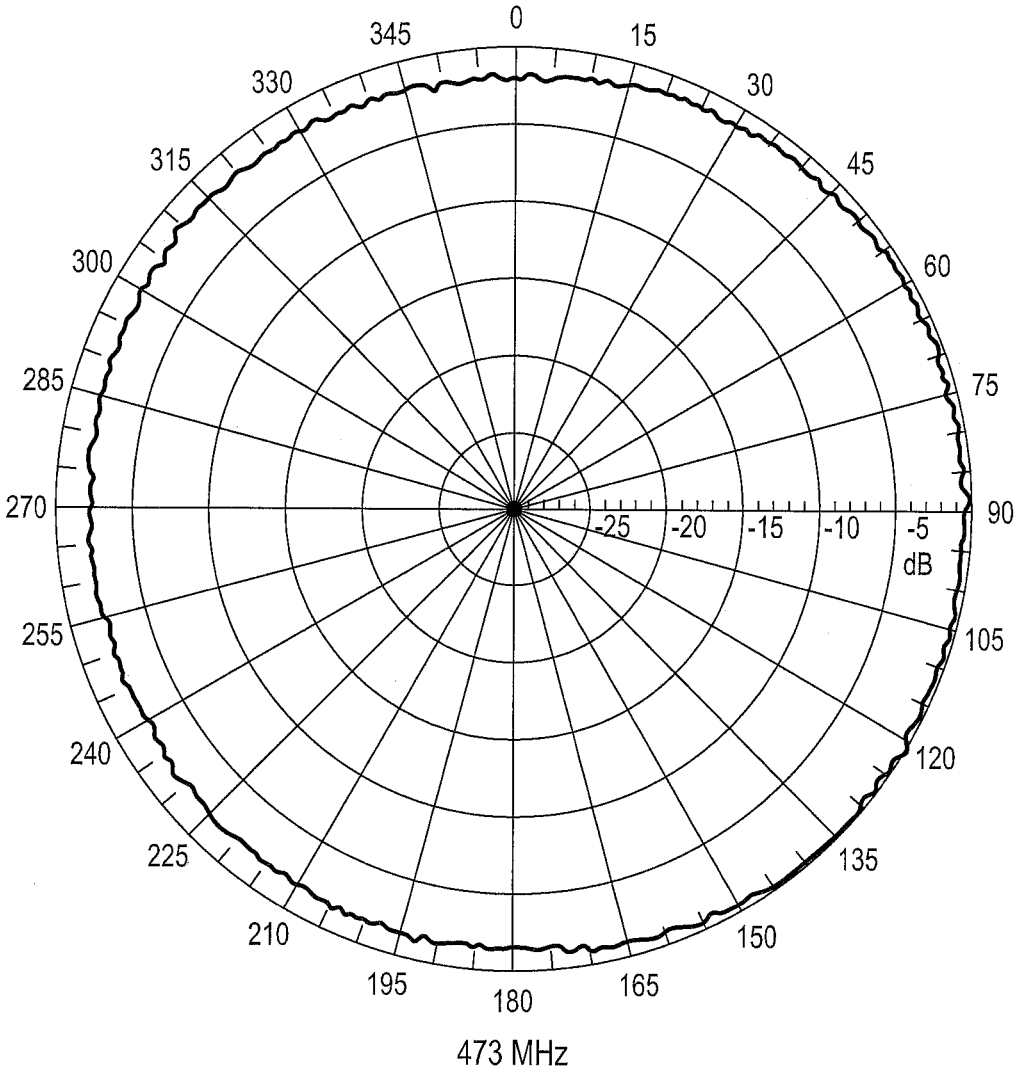
FIG. 14 is a graph of the radiation pattern at vertical measured at a frequency of 473 MHz for the antenna of the present invention shown in FIG. 13.
Figure 15:
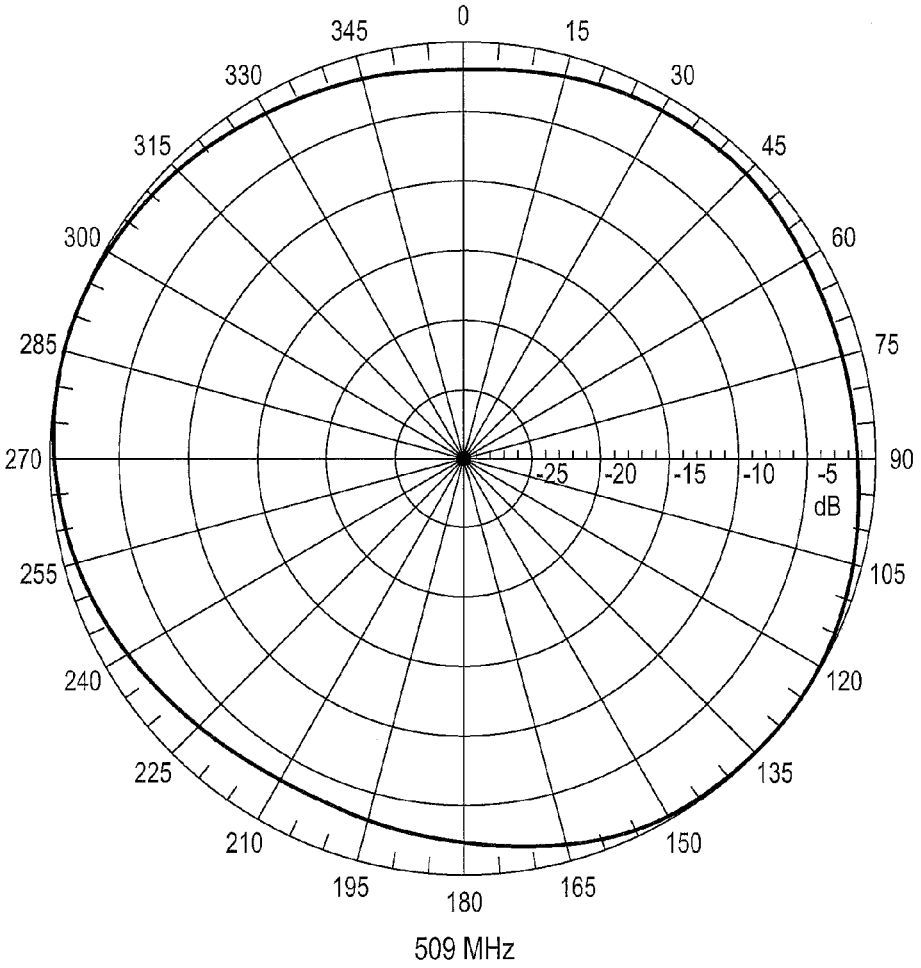
FIG. 15 is a graph of the radiation pattern at vertical measured at a frequency of 509 MHz for the antenna of the present invention shown in FIG. 13.
Figure 16:
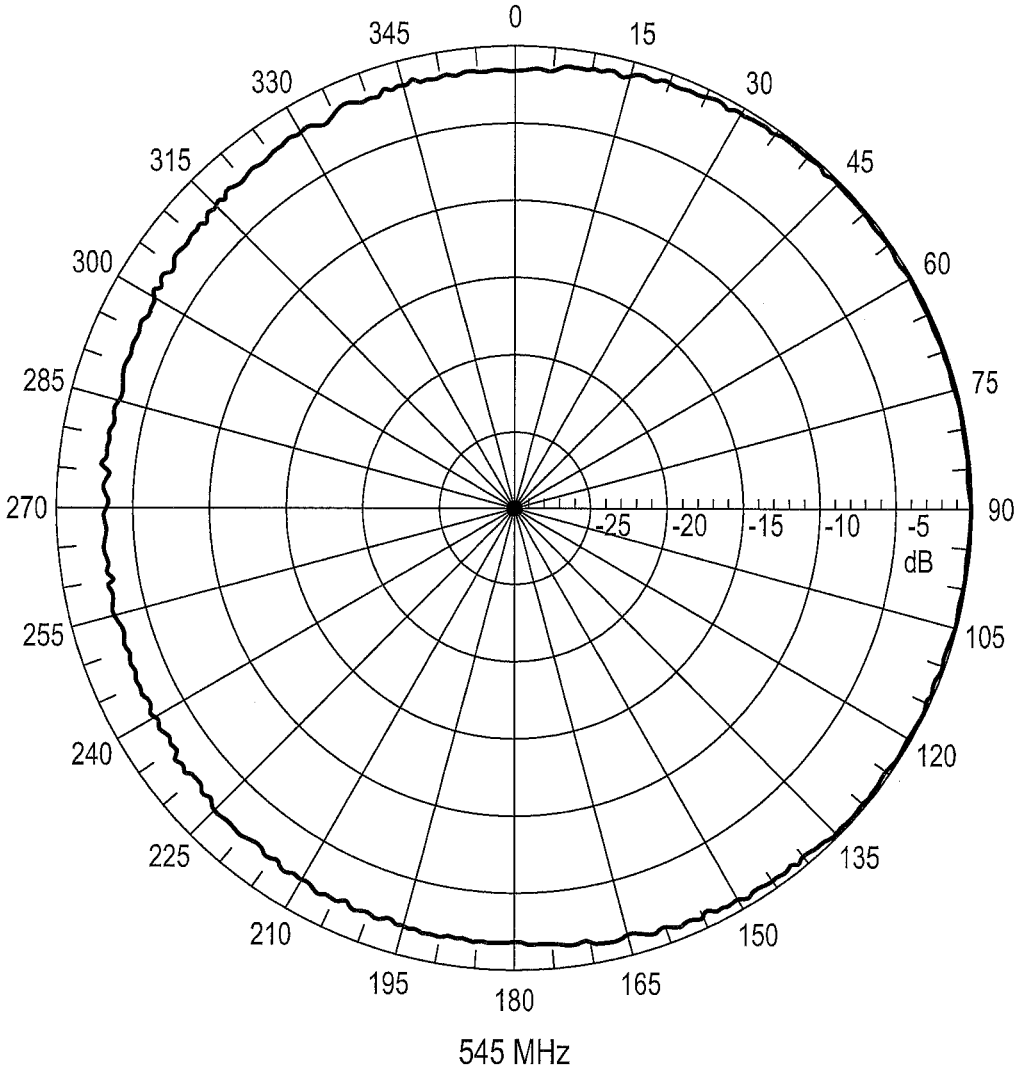
FIG. 16 is a graph of the radiation pattern at vertical measured at a frequency of 545 MHz for the antenna of the present invention shown in FIG. 13.
Figure 17:
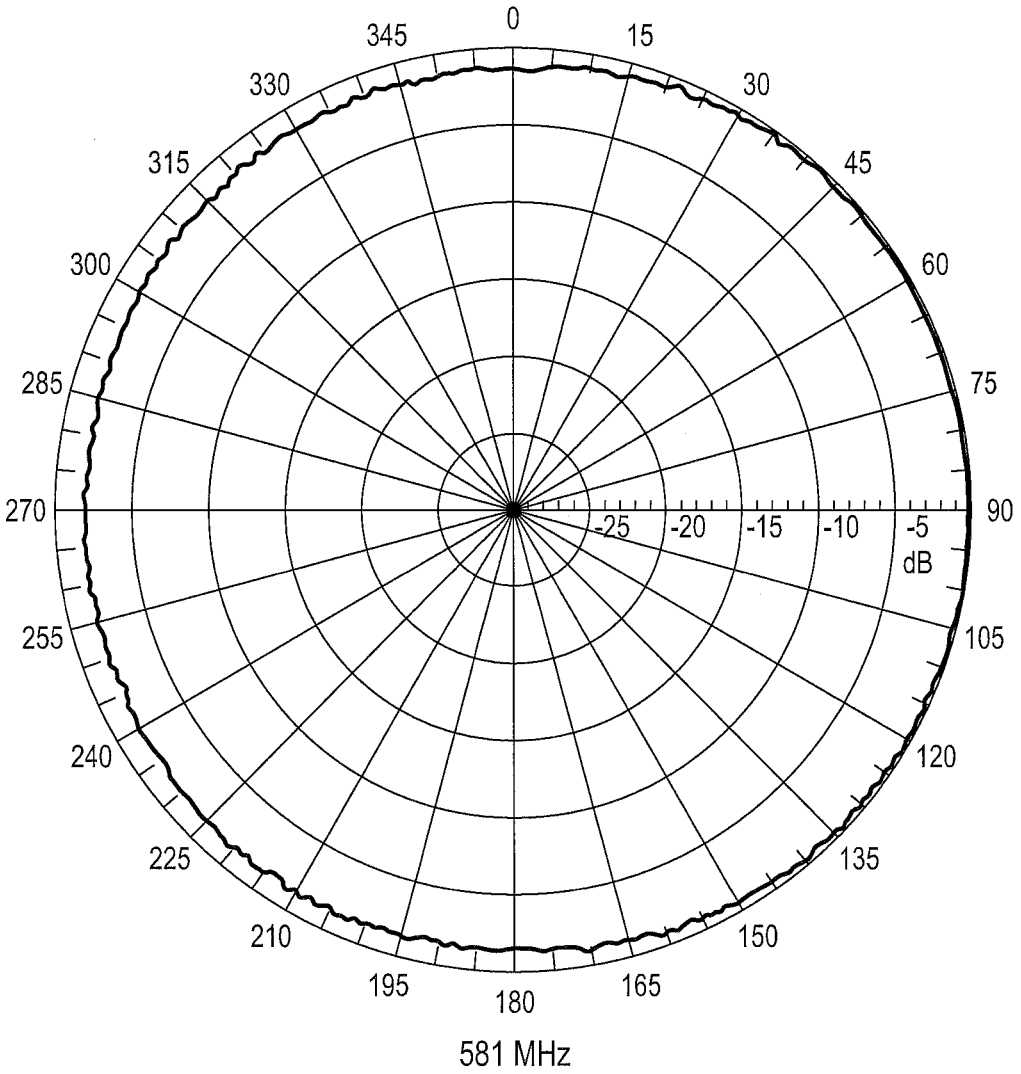
FIG. 17 is a graph of the radiation pattern at vertical measured at a frequency of 581 MHz for the antenna of the present invention shown in FIG. 13.
Figure 18:
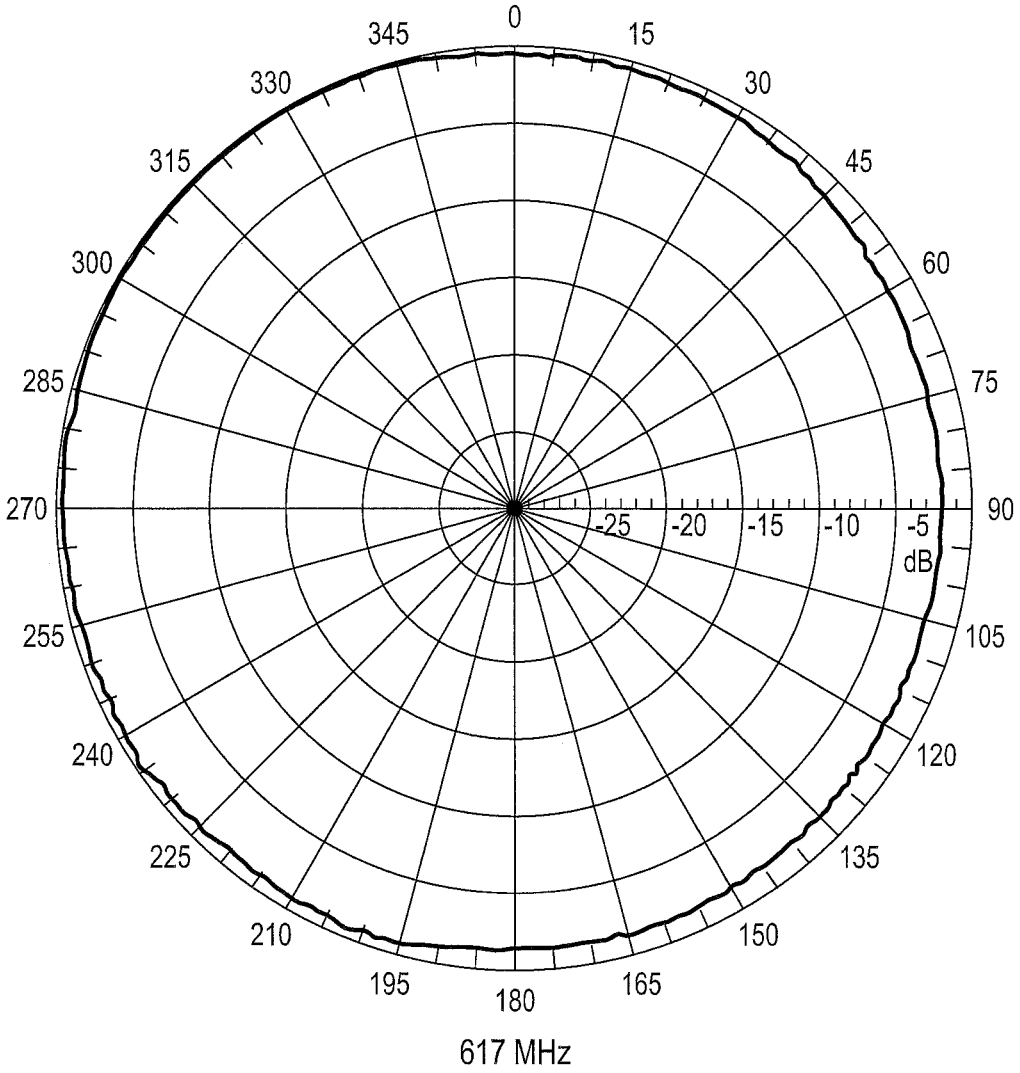
FIG. 18 is a graph of the radiation pattern at vertical measured at a frequency of 617 MHz for the antenna of the present invention shown in FIG. 13.
Figure 19:
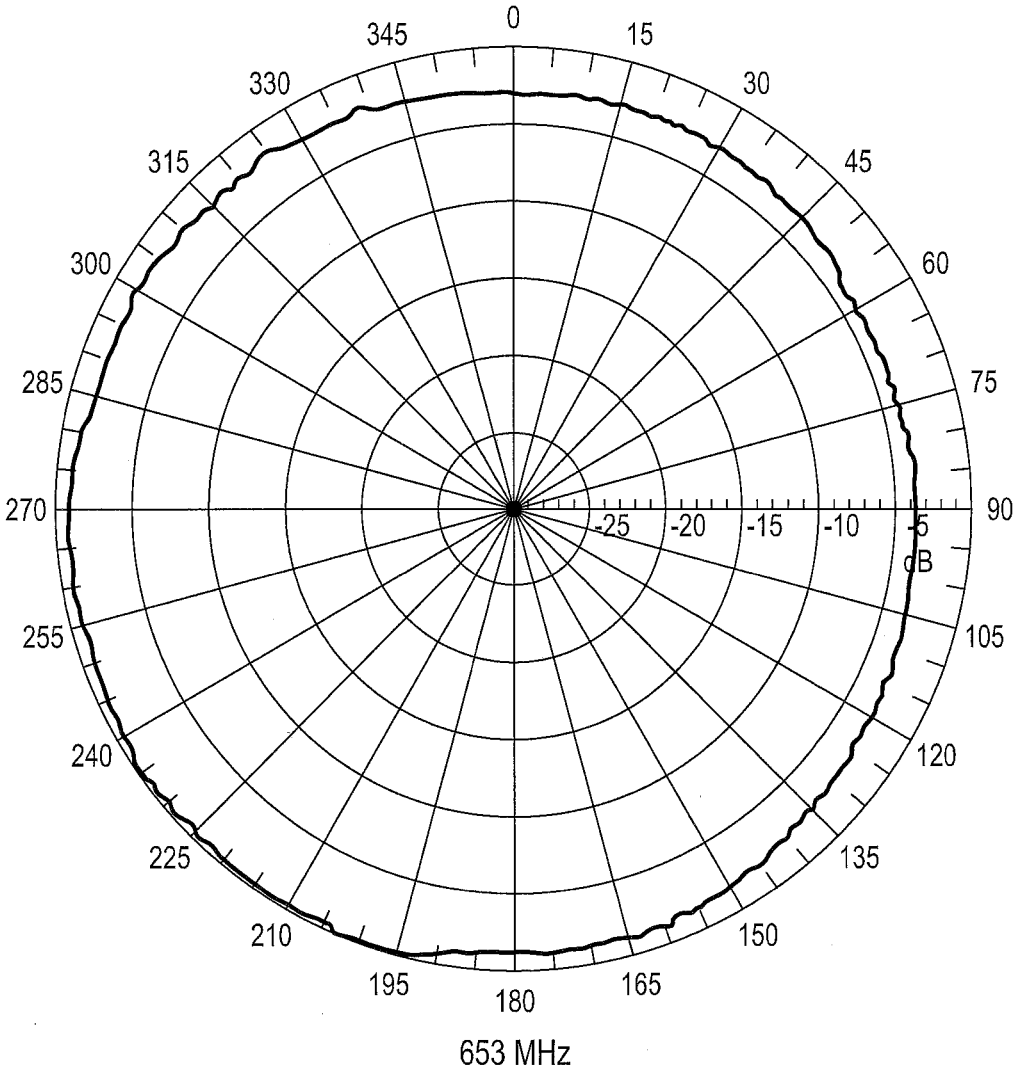
FIG. 19 is a graph of the radiation pattern at vertical measured at a frequency of 653 MHz for the antenna of the present invention shown in FIG. 13.
Figure 20:
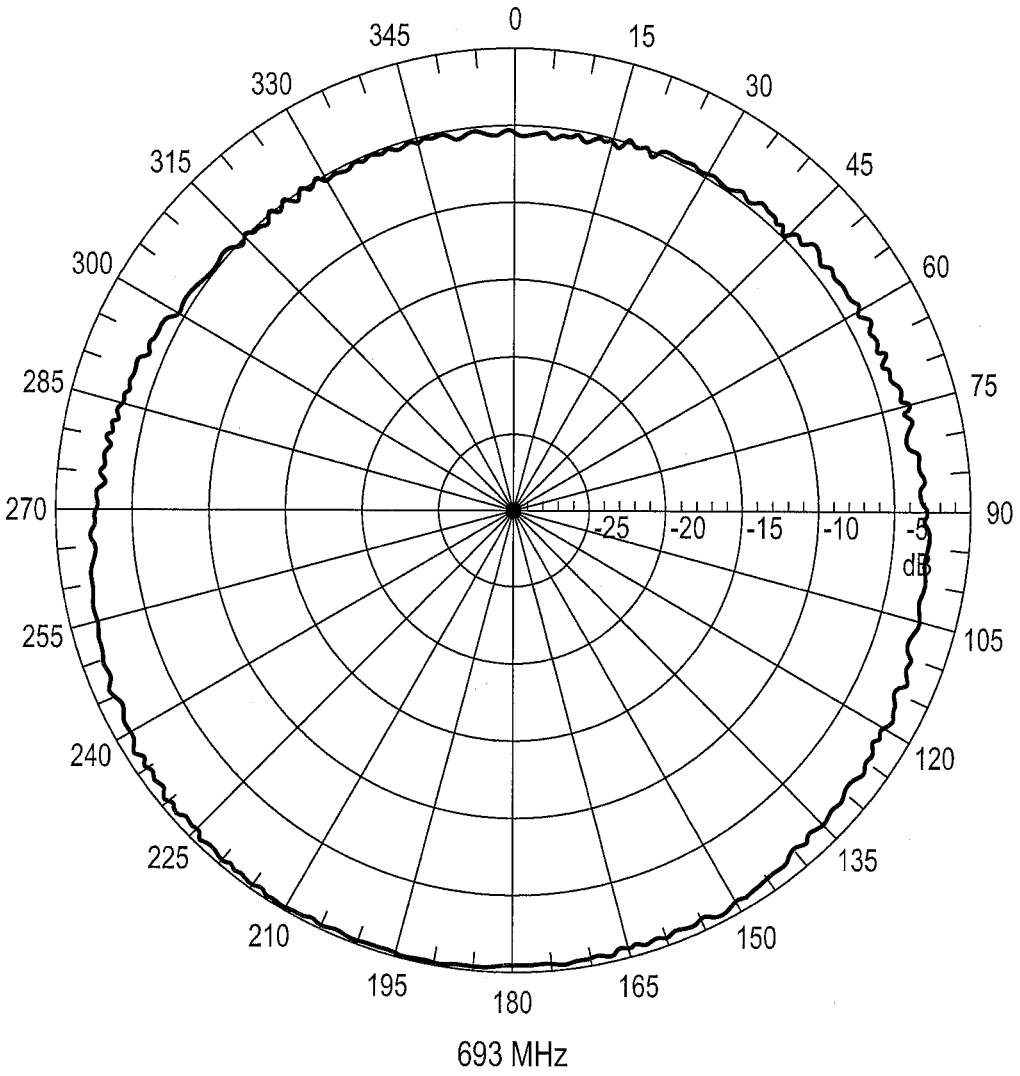
FIG. 20 is a graph of the radiation pattern at vertical measured at a frequency of 693 MHz for the antenna of the present invention shown in FIG. 13.

An alternative version of the broadband, low profile, planar wire antenna of the present invention is shown in FIGS. 13A and 13B of the drawings, and a series of radiation patterns at vertical measured at certain frequencies (in MHz) for this version of the antenna are shown in FIGS. 14-20. The alternative version of the antenna has many of the same elements of the antenna 1 shown in FIGS. 1A and 1B of the drawings, including an inverted triangular section 2 and a bar section 4 centered in proximity to the apex of the triangular section 2.

More specifically, the inverted triangular section 2 includes outer sloping sides and an apex 6 at least partially defined by the outer sloping sides. There is an elongated bar section 4 centered in proximity to the apex 6 of the inverted triangular section 2. This elongated bar section 4 is formed as an elongated member having a first axial end 56 and a second axial end 58 situated opposite the first axial end 56.

The inverted triangular section 2 includes, as antenna elements, a first outer sloping segment 8 and a second outer sloping segment 10. The first and second outer sloping segments 8, 10 define the outer sloping sides of the inverted triangular section 2. Each of the first outer sloping segment 8 and the second outer sloping segment 10 is an elongated member and has a proximate end 60 and a distal end 62 situated axially opposite the proximate end 60 of the respective first and second outer sloping segments 8, 10. The first and second outer sloping segments 8, 10 mutually converge in a direction towards the proximate ends 60 thereof such that the proximate ends 60 of the first and second outer sloping segments 8, 10 are electrically coupled together at the apex 6 of the inverted triangular section 2.

There is also a first side segment 12 and a second side segment 14, forming part of the inverted triangular section 2. The first side segment 12 is disposed in parallel with the second side segment 14. Each of the first side segment and the second side segment 12, 14 has a first axial end 64 and a second axial end 66 situated opposite the first axial end 64 of the respective first and second side segments 12, 14. The first axial end 64 of the first side segment 12 is electrically coupled to the distal end 62 of the first outer sloping segment 8, and the first axial end 64 of the second side segment 14 is electrically coupled to the distal end 62 of the second outer sloping segment 10.

The inverted triangular section 2 of this alternative embodiment of the antenna 1 shown in FIGS. 13A and 13B of the drawings also includes a base segment 16. The base segment 16 is situated on the inverted triangular section 2 opposite the apex 6 of the inverted triangular section 2. The base segment 16 is an elongated member and has a center portion 68, a first axial end 70 and a second axial end 72 situated opposite the first axial end 70 of the base segment 16. The first axial end 70 of the base segment 16 is electrically coupled to the second axial 66 end of the first side segment 12, and the opposite second axial end 72 of the base segment 16 is electrically coupled to the second axial end 66 of the second side segment 14. Thus, the second axial end 66 of the first side segment 12 and the first axial end 70 of the base segment 16 together define a first corner 24A of the inverted triangular section 2 of this alternative embodiment of the antenna 1, and the second axial end 66 of the second side segment 14 and the second axial end 72 of the base segment 16 together define a second corner 24B of the inverted triangular section 2 of the antenna 1.

The inverted triangular section 2 of the alternative embodiment of the antenna 1 also includes a center segment 18. The center segment 18 is an elongated member and has a proximate end 74 and a distal end 76 situated axially opposite the proximate end 74 of the center segment 18. The center segment 18 is disposed to extend between the apex 6 of the inverted triangular section 2 to the base segment 16, and slightly beyond the base segment 16, as will be described in greater detail. The proximate end 74 of the center segment 18 is electrically coupled to the proximate ends 60 of the first and second outer sloping segments 8, 10 at the apex 6 of the inverted triangular section 2, and near the distal end 76 of the center segment 18, a portion thereof is electrically coupled to the center portion 68 of the base segment 16.

The inverted triangular section 2 of this alternative embodiment of the antenna 1 also includes a first interior angled segment 20 and a second interior angled segment 22. The first interior angled segment 20 is disposed within the interior area 17 of the inverted triangular section 2 between the first outer sloping segment 8 and the center segment 18. Similarly, the second interior angled segment 22 is disposed within the interior area 17 of the inverted triangular section 2 between the second outer sloping segment 10 and the center segment 18. Each of the first interior angled segment 20 and the second interior angled segment 22 is formed as an elongated member and has a proximate end 78 and a distal end 80 situated axially opposite the proximate end 78 of the respective first and second interior angled segments 20, 22. Each of the first interior angled segment 20 and the second interior angled segment 22 extends between the apex 6 of the inverted triangular section 2 and the base segment 16. The proximate end 78 of the first interior angled segment 20 is electrically coupled to the proximate ends 60, 74 of the first outer sloping segment 8, the second outer sloping segment 10 and the center segment 18 at the apex 6 of the inverted triangular section 2. The distal end 80 of the first interior angled segment 20 is electrically coupled to the first axial end 70 of the base segment 16 near or at the first corner 24A of the inverted triangular section 2, and the distal end 80 of the second interior angled segment 22 is electrically coupled to the second axial end 72 of the base segment 16 near or at the second corner 24B of the inverted triangular section 2.

As stated previously, a portion 82 of the center segment 18, at the distal end 76 thereof, extends beyond the base segment 16 and is electrically coupled to the center portion 84 of a center-fed reflector 86. More specifically, the center-fed reflector 86 is an elongated member which extends in parallel with the base segment 16 and is spaced apart from the base segment 16 a predetermined distance. This center-fed reflector 86 also includes a first axial end 88 and a second axial end 90 situated opposite the first axial end 86.

In this alternative version of the antenna 1 of the present invention shown in FIGS. 13A and 13B of the drawings, the first and second tab segments 28, 29, and the third and fourth tab segments 30, 31, are electrically coupled not to the inverted triangular section 2 as is the case in the embodiment of the antenna 1 shown in FIGS. 1A and 1B, but rather are electrically coupled to the center-fed reflector 86 disposed above the base segment 16 of the inverted triangular section 2. More specifically, the first tab segment 28 is electrically coupled to the center-fed reflector 86 at or near the first axial end 88 thereof, and is in proximity to the first corner 24A of the inverted triangular section 2, and extends angularly outwardly from the first axial end 88 of the center-fed reflector 86 generally toward the first axial end 64 of the first side segment 12 and defines with the center-fed reflector 86 a first obtuse angle A8 generally facing the first corner 24A of the inverted triangular section 2.

Similarly, the second tab segment 29 is electrically coupled to the center-fed reflector 86 at or near the second axial end 90 thereof, and is in proximity to the second corner 24B of the inverted triangular section 2, and extends angularly outwardly from the second axial end 90 of the center-fed reflector 86 generally toward the first axial end 64 of the second side segment 14, and defines with the center-fed reflector 86 a second obtuse angle A9 generally facing the second corner 24B of the inverted triangular section 2.

The third tab segment 30 is electrically coupled to the center-fed reflector 86 at or near the first axial end 88 thereof and extends angularly outwardly from near or at the first axial end 88 of the center-fed reflector 86 away from the triangular section 2 and, preferably, in an opposite direction from which the first tab segment 28 extends. The third tab segment 30 defines with the center-fed reflector 86 a third acute angle A1. Similarly, the fourth tab segment 31 is electrically coupled to the center-fed reflector 86 at or near the second axial end 90 thereof and extends angularly outwardly from near or at the second axial end portion 90 of the center-fed reflector 86 away from the triangular section 2 and, preferably, in an opposite direction from which the second tab segment 29 extends. The fourth tab segment 31 defines with the center-fed reflector 86 a fourth acute angle A10.

Also, similarly to the antenna embodiment shown in FIGS. 1A and 1B, the apex 6 of the triangular section 2 of the antenna embodiment shown in FIGS. 13A and 13B is defined by a relatively short cross segment 26 from which the first and second outer sloping segments 8, 10 and other interior segments 12, 14 and center segment 18 of the triangular section 2 extend.

Like the first embodiment of the antenna 1 shown in FIGS. 1A and 1B of the drawings, this alternative version of the antenna shown in FIGS. 13A and 13B is also fed at the apex 6 of the triangular section 2 and the center portion of the lower bar section 4. More specifically, the center conductor of the antenna signal cable 42 is electrically connected to the center of cross segment 26 defining the apex 6 of the inverted triangular section 2, and the ground shield of the signal cable 42 is electrically connected to the center of the bar section 4, which acts as a ground plane for the antenna 1.

It should be noted that, on this embodiment shown in FIGS. 13A and 13B of the drawings, a first end segment 32 and a second end segment 33, as were included in the preferred form of the first embodiment of the antenna 1 shown in FIGS. 1A and 1B, have been omitted. However, it should be understood that such a first end segment 32 and a second end segment 33, which are preferably elongated members having a center portion, may be included and electrically coupled at their respective center portions to the opposite first axial end 56 and the second axial end 58, respectively, of the bar section 4, in order to help increase the effective electrical length of the antenna, and may have the same or similar dimensions as those of the first and second end segments 32, 33 of the antenna embodiment shown in FIGS. 1A and 1B.

Referring again to FIG. 13B of the drawings, the preferred dimensions and angles of the antenna element segments and tab elements of the triangular section 2, the bar section 4 and the center-fed reflector 86 are labeled L1-L20 and A1-A10, respectively, and the particular length and angles of each of the antenna elements of this alternative embodiment of the antenna are set forth in Table 2 below:

TABLE 2

| Preferred Lengths and Angles of the Antenna Segments of the Antenna Shown in FIGS. 13A and 13B |
|---|
| L1 = 13.0 inches |
| L2 = 0.21 inches |
| L3 = 0.45 inches |
| L4 = 0.50 inches |
| L5 = 0.60 inches |
| L6 = 4.12 inches |
| L7 = 6.57 inches |
| L8 = 0.38 inches |
| L9 = 0.35 inches |
| L10 = 0.71 inches |
| L11 = 0.29 inches |
| L12 = 1.44 inches |
| L13 = 7.05 inches |
| L14 = 0.20 inches |
| L15 = 0.60 inches |
| L16 = 0.10 inches |
| L17 = 2.00 inches |
| L18 = 10.0 inches |
| L19 = 12.22 inches |
| L20 = 0.19 inches |
| A1, A10 = 74.44 degrees |
| A2 = 65.45 degrees |
| A3 = 24.55 degrees |
| A4 = 152.57 degrees |
| A5 = 65.45 degrees |
| A6 = 60.43 degrees |
| A7 = 114.55 degrees |
| A8, A9 = 105.56 degrees |

The antenna 1 of the present invention shown in FIGS. 13A and 13B, and in FIGS. 1A and 1B (but without the reflector 86), generally and conceptually operates in the following manner. The base segment 16 acts as a dipole antenna, which is center-fed by center segment 18. The reflector 86 is situated behind (that is, above, when viewing FIGS. 13A and 13B) the dipole-acting base segment 16 to direct (reflect) radiation signals (in this case, received signals) from the dipole-acting base segment 16 downwardly (towards the apex 6) into the triangular section 2 of the antenna 1. The outer sloping segments 8, 10 and the inner sloping segments 20, 22 act as parasitic elements, or directors, which pick up power from the driven dipole-acting base segment 16 and re-radiate the signal outwardly from the antenna. The lower bar section 4 acts as a ground plane for the antenna 1. The tab elements 32, 33 (see FIGS. 1A and 1B) situated on opposite axial ends of the ground plane-acting bar section 4 increase the end effect of the antenna 1. The angled tab elements 28-31 added to the triangular section 2 increase the overall electrical length of the antenna 1 to simulate a physically larger size antenna. The straight (non-sloping) side segments 12, 14 also act as parasitic elements and help to direct the radiated signal in an omni-directional, horizontal plane (when the antenna is positioned vertically, as shown in FIGS. 1A, 1B, 13A and 13B).

Of course, what is described above is for a signal radiating antenna, but conceptually, the antenna 1 of the present invention functions in the same manner as a signal receiving antenna.

The finished antenna product, or assembly, 34 of the present invention, may incorporate either the antenna 1 shown in FIGS. 1A and 1B of the drawings, or the alternative version of the antenna shown in FIGS. 13A and 13B of the drawings. Thus, the antenna assembly 34 would include a front covering layer 36, which could be a polyimide or polycarbonate film, a rear covering layer 38, which could be a similar film or a paint layer, and the antenna situated between the two covering layers 36, 38. An antenna product 34, incorporating the antenna shown in FIGS. 13A and 13B of the drawings, would also have a housing 40 that covers the feed point and the connection of one end of the antenna cable 42 to the antenna 1 at the apex 6 thereof, where the housing includes two mating front and rear sections 44, 46, having the structure and contrasting colors described previously herein.

The structural features of various forms of the antenna of the present invention shown in FIGS. 1A and 1B, and in FIGS. 13A and 13B, will now be restated.

More specifically, a broadband low profile planar wire antenna, formed in accordance with the present invention, includes an inverted triangular section 2 having outer sloping sides and an apex 6 at least partially defined by the outer sloping sides, the inverted triangular section 2 having an interior area 17; and an elongated bar section 4 centered in proximity to the apex 6 of the inverted triangular section 2, the elongated bar section being formed as an elongated member having a first axial end 56 and a second axial end 58 situated opposite the first axial end 56.

Preferably, the inverted triangular section 2 includes, as antenna elements, a first outer segment 8 and a second outer segment 10. The first and second outer segments 8, 10 define the outer sloping sides of the inverted triangular section 2. Each of the first outer segment 8 and the second outer segment 10 is in the form of an elongated member and has a proximate end 60 and a distal end 62 situated axially opposite the proximate end 60 of the respective first and second outer segments 8, 10. The first and second outer segments 8, 10 mutually converge in a direction toward the proximate ends 60 thereof such that the proximate ends 60 of the first and second outer segments 8, 10 are electrically coupled together at the apex 6 of the inverted triangular section 2.

The inverted triangular section 2 further preferably includes a base segment 16. The base segment 16 is situated on the inverted triangular section 2 opposite the apex 6 of the inverted triangular section 2. The base segment 16 is in the form of an elongated member and has a center portion 68, a first axial end 70 and a second axial end 72 situated opposite the first axial end 70 of the base segment 16. The first axial end 70 of the base segment 16 is in electrical communication with the distal end 62 of the first outer segment 8, and the opposite second axial end 72 of the base segment 16 is in electrical communication with the distal end 62 of the second outer segment 10. The first axial end 70 of the base segment 16 at least partially defines a first corner 24A of the inverted triangular section 2 of the antenna 1, and the second axial end 72 of the base segment 16 at least partially defines a second corner 24B of the inverted triangular section 2 of the antenna 1.

The antenna 1 of the present invention further preferably includes at least a first tab segment 28 and a second tab segment 29 situated in proximity respectively to the first corner 24A and the second corner 24B of the inverted triangular section 2 of the antenna 1. The at least first tab element 28 and the second tab element 29 are provided to help increase the effective electrical length of the antenna 1.

In a more preferred form of the antenna 1 of the present invention, the inverted triangular section 2 further includes a center segment 18. The center segment 18 is formed as an elongated member and has a proximate end 74 and a distal end 76 situated axially opposite the proximate end 74 of the center segment 18. The center segment 18 is disposed at least partially within the interior area 17 of the inverted triangular section 2 and extends between the apex 6 of the inverted triangular section 2 and the base segment 16. The proximate end 74 of the center segment 18 is electrically coupled to the proximate ends 60 of the first and second outer segments 8, 10 at the apex 6 of the inverted triangular section 2, and a portion of the center segment 18 near or at the distal end 76 of the center segment 18 is electrically coupled to the center portion 68 of the base segment 16.

Preferably, the antenna 1 of the present invention further includes a first end segment 32 and a second end segment 33. Each of the first end segment 32 and the second end segment 33 is in the form of an elongated member and has a center portion. The first axial end 56 of the bar section 4 is electrically coupled to the center portion of the first end segment 32, and the second axial end 58 of the bar section 4 is electrically coupled to the center portion of the second end segment 33. The first end segment 32 and the second end segment 33 are provided to help increase the effective electrical length of the bar section 4.

In an even more preferred form of the present invention, such as illustrated by FIGS. 1A and 1B of the drawings, a broadband low profile planar wire antenna 1 includes an inverted triangular section 2 having outer sloping sides and an apex 6 at least partially defined by the outer sloping sides, the inverted triangular section 2 having an interior area 17; and an elongated bar section 4 centered in proximity to the apex 6 of the inverted triangular section 2, the elongated bar section 4 being formed as an elongated member having a first axial end 56 and a second axial end 58 situated opposite the first axial end 56.

In this preferred form of the antenna 1 of the present invention, the inverted triangular section 2 and elongated bar section 4 include, as antenna elements, a first outer sloping segment 8 and a second outer sloping segment 10. The first and second outer sloping segments 8, 10 define the outer sloping sides of the inverted triangular section 2. Each of the first outer sloping segment 8 and the second outer sloping segment 10 is in the form of an elongated member and has a proximate end 60 and a distal end 62 situated axially opposite the proximate end 60 of the respective first and second outer sloping segments 8,10. The first and second outer sloping segments 8, 10 mutually converge in a direction toward the proximate ends 60 thereof such that the proximate ends 60 of the first and second outer sloping segments 8, 10 are electrically coupled together at the apex 6 of the inverted triangular section 2.

In this preferred form of the antenna of the present invention, the inverted triangular section 2 further includes a first side segment 12 and a second side segment 14. The first side segment 12 is disposed in parallel with the second side segment 14. Each of the first side segment 12 and the second side segment 14 is in the form of an elongated member and has a first axial end 64 and a second axial end 66 situated opposite the first axial end 64 of the respective first and second side segments 12, 14. The first axial end 64 of the first side segment 12 is electrically coupled to the distal end 62 of the first outer sloping segment 8, and the first axial end 64 of the second side segment 14 is electrically coupled to the distal end 62 of the second outer sloping segment 10.

The inverted triangular section 2 of the antenna 1 of the present invention, in this preferred form, further includes a base segment 16. The base segment 16 is situated on the inverted triangular section 2 opposite the apex 6 of the inverted triangular section 2. The base segment 16 is in the form of an elongated member and has a center portion 68, a first axial end 70 and a second axial end 72 situated opposite the first axial end 70 of the base segment 16. The first axial end 70 of the base segment 16 is electrically coupled to the second axial end 66 of the first side segment 12, and the opposite second axial end 72 of the base segment 16 is electrically coupled to the second axial end 66 of the second side segment 14. Accordingly, the second axial end 66 of the first side segment 12 and the first axial end 70 of the base segment 16 together define a first corner 24A of the inverted triangular section 2 of the antenna 1, and, similarly, the second axial end 66 of the second side segment 14 and the second axial end 72 of the base segment 16 together define a second corner 24B of the inverted triangular section 2 of the antenna 1.

The inverted triangular section 2 of this preferred embodiment of the antenna 1 further includes a center segment 18. The center segment 18 is in the form of an elongated member and has a proximate end 74 and a distal end 76 situated axially opposite the proximate end 74 of the center segment 18. The center segment 18 is disposed within the interior area 17 of the inverted triangular section 2 and extends between the apex 6 of the inverted triangular section 2 and the base segment 16. The proximate end 74 of the center segment 18 is electrically coupled to the proximate ends 60 of the first and second outer sloping segments 8, 10 at the apex 6 of the inverted triangular section 2, and the distal end 76 of the center segment 18 is electrically coupled to the center portion 68 of the base segment 16.

The inverted triangular section 2 of the antenna 1 of the present invention, in such a preferred form, as shown in FIGS. 1A and 1B of the drawings, further includes a first interior angled segment 20 and a second interior angled segment 22. The first interior angled segment 20 is disposed within the interior area 17 of the inverted triangular section 2 between the first outer sloping segment 8 and the center segment 18, and the second interior angled segment 22 is disposed within the interior area 17 of the inverted triangular section 2 between the second outer sloping segment 10 and the center segment 18. Each of the first interior angled segment 20 and the second interior angled segment 22 is in the form of an elongated member and has a proximate end 78 and a distal end 80 situated axially opposite the proximate end 78 of the respective first and second interior angled segments 20, 22. Each of the first interior angled segment 20 and the second interior angled segment 22 extends between the apex 6 of the inverted triangular section 2 and the base segment 16. The proximate ends 78 of the first interior angled segment 20 and the second interior angled segment 22 are electrically coupled to the proximate ends 60, 74 of the first outer sloping segment 8, the second outer sloping segment 10 and the center segment 18 at the apex 6 of the inverted triangular section 2. The distal end 80 of the first interior angled segment 20 is electrically coupled to the first axial end 70 of the base segment 16 at or near the first corner 24A of the inverted triangular section 2, and the distal end 80 of the second interior angled segment 22 is electrically coupled to the second axial end 72 of the base segment 16 at or near the second corner 24B of the inverted triangular section 2.

The preferred form of the inverted triangular section 2 of the antenna 1 of the present invention further includes a first tab segment 28 and a second tab segment 29. The first tab segment 28 is electrically coupled to the second axial end 66 of the first side segment 12 at or near the first corner 24A of the inverted triangular section 2 and extends angularly outwardly from the second axial end 66 of the first side segment 12 generally toward the first axial end 64 of the first side segment 12 to define with the first side segment 12 a first acute angle. Similarly, the second tab segment 29 is electrically coupled to the second axial end 66 of the second side segment 14 at or near the second corner 24B of the inverted triangular section 2 and extends angularly outwardly from the second axial end 66 of the second side segment 14 generally toward the first axial end 64 of the second side segment 14 to define with the second side segment 14 a second acute angle.

The inverted triangular section 2 of this preferred form of the antenna 1 of the present invention further includes a third tab segment 30 and a fourth tab segment 31. The third tab segment 30 is electrically coupled to the distal end 80 of the first interior angled segment 20 at or near the first corner 24A of the inverted triangular section 2 and extends angularly outwardly from the first axial end 70 of the base segment 16 to define with the base segment 16 a third acute angle. Similarly, the fourth tab segment 31 is electrically coupled to the distal end 80 of the second interior angled segment 22 at or near the second corner 24B of the inverted triangular section 2 and extends angularly outwardly from the second axial end 72 of the base segment 16 to define with the base segment 16 a fourth acute angle.

The antenna 1, in this preferred form, further includes a first end segment 32 and a second end segment 33. Each of the first end segment 32 and the second end segment 33 is in the form of an elongated member and has a center portion. The first axial end 56 of the bar section 4 is electrically coupled to the center portion of the first end segment 32, and the second axial end 58 of the bar section 4 is electrically coupled to the center portion of the second end segment 33.

In another preferred form of the present invention, such as illustrated by FIGS. 13A and 13B of the drawings, a broadband low profile planar wire antenna 1 includes an inverted triangular section 2 having outer sloping sides and an apex 6 at least partially defined by the outer sloping sides, the inverted triangular section 2 having an interior area 17; an elongated bar section 4 centered in proximity to the apex 6 of the inverted triangular section 2, the elongated bar section 4 being formed as an elongated member having a first axial end 56 and a second axial end 58 situated opposite the first axial end 56; and a center-fed reflector 86, the center-fed reflector 86 being formed as an elongated member and having a first axial end 88 and a second axial end 90 situated opposite the first axial end 88, the center-fed reflector 86 being situated in proximity to the inverted triangular section 2 opposite the apex 6 thereof and outside the interior area 17 of the inverted triangular section 2.

In this preferred form, the inverted triangular section 2, elongated bar section 4 and center-fed reflector 86 include, as antenna elements, a first outer sloping segment 8 and a second outer sloping segment 10. The first and second outer sloping segments 8, 10 define the outer sloping sides of the inverted triangular section 2. Each of the first outer sloping segment 8 and the second outer sloping segment 10 is in the form of an elongated member and has a proximate end 60 and a distal end 62 situated axially opposite the proximate end 60 of the respective first and second outer sloping segments 8, 10. The first and second outer sloping segments 8, 10 mutually converge in a direction toward the proximate ends 60 thereof such that the proximate ends 60 of the first and second outer sloping segments 8, 10 are electrically coupled together at the apex 6 of the inverted triangular section 2.

The inverted triangular section 2 of this preferred form of the antenna 1 of the present invention further includes a first side segment 12 and a second side segment 14. The first side segment 12 is disposed in parallel with the second side segment 14. Each of the first side segment 12 and the second side segment 14 is in the form of an elongated member and has a first axial end 64 and a second axial end 66 situated opposite the first axial end 64 of the respective first and second side segments 12, 14. The first axial end 64 of the first side segment 12 is electrically coupled to the distal end 62 of the first outer sloping segment 8, and the first axial end 64 of the second side segment 14 is electrically coupled to the distal end 62 of the second outer sloping segment 10.

The inverted triangular section 2 of the aforementioned preferred antenna 1 also includes a base segment 16. The base segment 16 is situated on the inverted triangular section 2 opposite the apex 6 of the inverted triangular section 2. The base segment 16 is in the form of an elongated member and has a center portion 68, a first axial end 70 and a second axial end 72 situated opposite the first axial end 70 of the base segment 16. The first axial end 70 of the base segment 16 is electrically coupled to the second axial end 66 of the first side segment 12, and the opposite second axial end 72 of the base segment 16 is electrically coupled to the second axial end 66 of the second side segment 14. Accordingly, the second axial end 66 of the first side segment 12 and the first axial end 70 of the base segment 16 together define a first corner 24A of the inverted triangular section 2 of the antenna 1, and, similarly, the second axial end 66 of the second side segment 14 and the second axial end 72 of the base segment 16 together define a second corner 24B of the inverted triangular section 2 of the antenna 1.

The inverted triangular section 2 of the antenna 1, in this preferred form, and as shown in FIGS. 13A and 13B of the drawings, also includes a center segment 18. The center segment 18 is in the form of an elongated member and has a proximate end 74 and an extended distal end portion 82 situated axially opposite the proximate end 74 of the center segment 18. The center segment 18 is disposed at least partially within the interior area 17 of the inverted triangular section 2 and extends from the apex 6 of the inverted triangular section 2 to the base segment 16. The extended distal end portion 82 extends outwardly from the base segment 16 in a direction away from the apex 6. The proximate end 74 of the center segment 18 is electrically coupled to the proximate ends 60 of the first and second outer sloping segments 8, 10 at the apex 6 of the inverted triangular section 2, and the center segment 18 is electrically coupled to the center portion 68 of the base segment 16 near the extended distal end portion 82 thereof.

This antenna 1 of the present invention preferably includes, as part of the inverted triangular section 2, a first interior angled segment 20 and a second interior angled segment 22. More specifically, the first interior angled segment 20 is disposed within the interior area 17 of the inverted triangular section 2 between the first outer sloping segment 8 and the center segment 18, and the second interior angled segment 22 is disposed within the interior area 17 of the inverted triangular section 2 between the second outer sloping segment 10 and the center segment 18. Each of the first interior angled segment 20 and the second interior angled segment 22 is in the form of an elongated member and has a proximate end 78 and a distal end 80 situated axially opposite the proximate end 78 of the respective first and second interior angled segments 20, 22. Each of the first interior angled segment 20 and the second interior angled segment 22 extends between the apex 6 of the inverted triangular section 2 and the base segment 16. The proximate ends 78 of the first interior angled segment 20 and the second interior angled segment 22 are electrically coupled to the proximate ends 60, 74 of the first outer sloping segment 8, the second outer sloping segment 10 and the center segment 18 at the apex 6 of the inverted triangular section 2. The distal end 80 of the first interior angled segment 20 is electrically coupled to the first axial end 70 of the base segment 16 near or at the first corner 24A of the inverted triangular section 2, and the distal end 80 of the second interior angled segment 22 is electrically coupled to the second axial end 72 of the base segment 16 near or at the second corner 24B of the inverted triangular section 2.

The antenna 1 of the present invention, in this preferred form, further includes a first tab segment 28 and a second tab segment 29. The first tab segment 28 is electrically coupled to the center-fed reflector 86 at or near the first axial end 88 thereof and is situated in proximity to the first corner 24A of the inverted triangular section 2 and extends angularly outwardly from the center-fed reflector 86 to define with the center-fed reflector 86 a first angle. Similarly, the second tab segment 29 is electrically coupled to the center-fed reflector 86 at or near the second axial end 90 thereof and is situated in proximity to the second corner 24B of the inverted triangular section 2 and extends angularly outwardly from the center-fed reflector 86 to define with the center-fed reflector 86 a second angle.

Additionally, the antenna 1 of the present invention in this preferred form also has a third tab segment 30 and a fourth tab segment 31. The third tab segment 30 is electrically coupled to the center-fed reflector 86 at or near the first axial end 88 thereof and extends angularly outwardly from or near the first axial end 88 of the center-fed reflector 86 away from the inverted triangular section 2 and in an opposite direction from which the first tab segment 28 extends and defines with the center-fed reflector 86 a third acute angle. Similarly, the fourth tab segment 31 is electrically coupled to the center-fed reflector 86 at or near the second axial end 90 thereof and extends angularly outwardly from or near the second axial end 90 of the center-fed reflector 86 away from the inverted triangular section 2 and in an opposite direction from which the second tab segment 29 extends and defines with the center-fed reflector 86 a fourth acute angle.

An antenna assembly 34, formed in accordance with the present invention, may include the antenna 1 described previously and shown in FIGS. 1A and 1B, or the antenna 1 described previously and shown in FIGS. 13A and 13B, as well as a thin front covering layer 36 and a thin rear covering layer 38. The antenna 1 is situated between the front covering layer 36 and the rear covering layer 38. The front covering layer 36 has an outer surface 92, and the rear covering layer 38 has an outer surface 94. The outer surface 92 of the front covering layer 36 faces away from the outer surface 94 of the rear covering layer 38.

Preferably, the overall thickness of the antenna assembly 34, measured between the outer surface 92 of the front covering layer 36 and the outer surface 94 of the rear covering layer 38, is less than about one millimeter. In a more preferred form, the front covering layer 36 of the antenna assembly 34 includes a film which supports the antenna 1, and the rear covering layer 38 is a layer of paint.

In an even more preferred form of the antenna assembly 34, the outer surface 92 of the front covering layer 36 is formed with a first color, and the outer surface 94 of the rear covering layer 38 is formed with a second color, the first color of the outer surface 92 of the front covering layer 36 being different from the second color of the outer surface 94 of the rear covering layer 38.

Also, in a further preferred form, the antenna assembly 34 further includes an antenna cable connection housing 40 having a front section 44 and a rear section 46 which mates with the front section 44 of the antenna cable connection housing 40. The front section 44 of the antenna cable connection housing 40 is disposed on a portion of the front covering layer 36, and the rear section 46 of the antenna cable connection housing 40 is disposed on a portion of the rear covering layer 38. The front section 44 of the antenna cable connection housing 40 preferably has a color which is the same as the first color of the outer surface 92 of the front covering layer 36, and the rear section 46 of the antenna cable connection housing 40 preferably has a color which is the same as the second color of the rear covering layer 38.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A broadband low profile planar wire antenna, which comprises:

an inverted triangular section having outer sloping sides and an apex at least partially defined by the outer sloping sides, the inverted triangular section having an interior area; and an elongated bar section centered in proximity to the apex of the inverted triangular section, the elongated bar section being formed as an elongated member having a first axial end and a second axial end situated opposite the first axial end;

wherein the inverted triangular section includes, as antenna elements:

a first outer segment and a second outer segment, the first and second outer segments defining the outer sloping sides of the inverted triangular section, each of the first outer segment and the second outer segment being an elongated member and having a proximate end and a distal end situated axially opposite the proximate end of the respective first and second outer segments, the first and second outer segments mutually converging in a direction toward the proximate ends thereof such that the proximate ends of the first and second outer segments are electrically coupled together at the apex of the inverted triangular section;

a base segment, the base segment being situated on the inverted triangular section opposite the apex of the inverted triangular section, the base segment being an elongated member and having a center portion, a first axial end and a second axial end situated opposite the first axial end of the base segment, the first axial end of the base segment being in electrical communication with the distal end of the first outer segment, and the opposite second axial end of the base segment being in electrical communication with the distal end of the second outer segment, the first axial end of the base segment at least partially defining a first corner of the inverted triangular section of the antenna, and the second axial end of the base segment at least partially defining a second corner of the inverted triangular section of the antenna; and at least a first tab segment and a second tab segment situated in proximity respectively to the first corner and the second corner of the inverted triangular section of the antenna, the at least first tab element and the second tab element being provided to help increase the effective electrical length of the antenna.

2. An antenna as defined by claim 1, wherein the inverted triangular section further includes:

a center segment, the center segment being an elongated member and having a proximate end and a distal end situated axially opposite the proximate end of the center segment, the center segment being disposed at least partially within the interior area of the inverted triangular section and extending between the apex of the inverted triangular section and the base segment, the proximate end of the center segment being electrically coupled to the proximate ends of the first and second outer segments at the apex of the inverted triangular section, and a portion of the center segment near or at the distal end of the center segment being electrically coupled to the center portion of the base segment.

3. An antenna as defined by claim 1, which further comprises:

a first end segment and a second end segment, each of the first end segment and the second end segment being an elongated member and having a center portion, the first axial end of the bar section being electrically coupled to the center portion of the first end segment, and the second axial end of the bar section being electrically coupled to the center portion of the second end segment, the first end segment and the second end segment being provided to help increase the effective electrical length of the bar section.

4. An antenna assembly, which comprises:

an antenna as defined by claim 1; and a thin front covering layer and a thin rear covering layer, the antenna being situated between the front covering layer and the rear covering layer, the front covering layer having an outer surface, and the rear covering layer having an outer surface, the outer surface of the front covering layer facing away from the outer surface of the rear covering layer.

5. An antenna assembly as defined by claim 4, wherein the overall thickness of the antenna assembly, measured between the outer surface of the front covering layer and the outer surface of the rear covering layer, is less than about one millimeter.

6. An antenna assembly as defined by claim 4, wherein the front covering layer includes a film which supports the antenna, and wherein the rear covering layer is a layer of paint.

7. An antenna assembly as defined by claim 4, wherein the outer surface of the front covering layer is formed with a first color, and the outer surface of the rear covering layer is formed with a second color, the first color of the outer surface of the front covering layer being different from the second color of the outer surface of the rear covering layer.

8. An antenna assembly as defined by claim 7, which further comprises:

an antenna cable connection housing having a front section and a rear section which mates with the front section of the antenna cable connection housing, the front section of the antenna cable connection housing being disposed on a portion of the front covering layer, and the rear section of the antenna cable connection housing being disposed on a portion of the rear covering layer;

wherein the front section of the antenna cable connection housing has a color which is the same as the first color of the outer surface of the front covering layer, and the rear section of the antenna cable connection housing has a color which is the same as the second color of the rear covering layer.

9. A broadband low profile planar wire antenna, which comprises:

an inverted triangular section having outer sloping sides and an apex at least partially defined by the outer sloping sides, the inverted triangular section having an interior area; and an elongated bar section centered in proximity to the apex of the inverted triangular section, the elongated bar section being formed as an elongated member having a first axial end and a second axial end situated opposite the first axial end;

wherein the inverted triangular section and elongated bar section include, as antenna elements:

a first outer sloping segment and a second outer sloping segment, the first and second outer sloping segments defining the outer sloping sides of the inverted triangular section, each of the first outer sloping segment and the second outer sloping segment being an elongated member and having a proximate end and a distal end situated axially opposite the proximate end of the respective first and second outer sloping segments, the first and second outer sloping segments mutually converging in a direction toward the proximate ends thereof such that the proximate ends of the first and second outer sloping segments are electrically coupled together at the apex of the inverted triangular section;

a first side segment and a second side segment, the first side segment being disposed in parallel with the second side segment, each of the first side segment and the second side segment being an elongated member and having a first axial end and a second axial end situated opposite the first axial end of the respective first and second side segments, the first axial end of the first side segment being electrically coupled to the distal end of the first outer sloping segment, and the first axial end of the second side segment being electrically coupled to the distal end of the second outer sloping segment;

a base segment, the base segment being situated on the inverted triangular section opposite the apex of the inverted triangular section, the base segment being an elongated member and having a center portion, a first axial end and a second axial end situated opposite the first axial end of the base segment, the first axial end of the base segment being electrically coupled to the second axial end of the first side segment, and the opposite second axial end of the base segment being electrically coupled to the second axial end of the second side segment, whereby the second axial end of the first side segment and the first axial end of the base segment together define a first corner of the inverted triangular section of the antenna, and whereby the second axial end of the second side segment and the second axial end of the base segment together define a second corner of the inverted triangular section of the antenna;

a center segment, the center segment being an elongated member and having a proximate end and a distal end situated axially opposite the proximate end of the center segment, the center segment being disposed within the interior area of the inverted triangular section and extending between the apex of the inverted triangular section and the base segment, the proximate end of the center segment being electrically coupled to the proximate ends of the first and second outer sloping segments at the apex of the inverted triangular section, and the distal end of the center segment being electrically coupled to the center portion of the base segment;

a first interior angled segment and a second interior angled segment, the first interior angled segment being disposed within the interior area of the inverted triangular section between the first outer sloping segment and the center segment, and the second interior angled segment being disposed within the interior area of the inverted triangular section between the second outer sloping segment and the center segment, each of the first interior angled segment and the second interior angled segment being an elongated member and having a proximate end and a distal end situated axially opposite the proximate end of the respective first and second interior angled segments, each of the first interior angled segment and the second interior angled segment extending between the apex of the inverted triangular section and the base segment, the proximate ends of the first interior angled segment and the second interior angled segment being electrically coupled to the proximate ends of the first outer sloping segment, the second outer sloping segment and the center segment at the apex of the inverted triangular section, the distal end of the first interior angled segment being electrically coupled to the first axial end of the base segment at or near the first corner of the inverted triangular section, and the distal end of the second interior angled segment being electrically coupled to the second axial end of the base segment at or near the second corner of the inverted triangular section;

a first tab segment and a second tab segment, the first tab segment being electrically coupled to the second axial end of the first side segment at or near the first corner of the inverted triangular section and extending angularly outwardly from the second axial end of the first side segment generally toward the first axial end of the first side segment to define with the first side segment a first acute angle, the second tab segment being electrically coupled to the second axial end of the second side segment at or near the second corner of the inverted triangular section and extending angularly outwardly from the second axial end of the second side segment generally toward the first axial end of the second side segment to define with the second side segment a second acute angle;

a third tab segment and a fourth tab segment, the third tab segment being electrically coupled to the distal end of the first interior angled segment at or near the first corner of the inverted triangular section and extending angularly outwardly from the first axial end of the base segment to define with the base segment a third acute angle, the fourth tab segment being electrically coupled to the distal end of the second interior angled segment at or near the second corner of the inverted triangular section and extending angularly outwardly from the second axial end of the base segment to define with the base segment a fourth acute angle; and a first end segment and a second end segment, each of the first end segment and the second end segment being an elongated member and having a center portion, the first axial end of the bar section being electrically coupled to the center portion of the first end segment, and the second axial end of the bar section being electrically coupled to the center portion of the second end segment.

10. An antenna assembly, which comprises:

an antenna as defined by claim 9; and a thin front covering layer and a thin rear covering layer, the antenna being situated between the front covering layer and the rear covering layer, the front covering layer having an outer surface, and the rear covering layer having an outer surface, the outer surface of the front covering layer facing away from the outer surface of the rear covering layer.

11. An antenna assembly as defined by claim 10, wherein the overall thickness of the antenna assembly, measured between the outer surface of the front covering layer and the outer surface of the rear covering layer, is less than about one millimeter.

12. An antenna assembly as defined by claim 10, wherein the front covering layer includes a film which supports the antenna, and wherein the rear covering layer is a layer of paint.

13. An antenna assembly as defined by claim 10, wherein the outer surface of the front covering layer is formed with a first color, and the outer surface of the rear covering layer is formed with a second color, the first color of the outer surface of the front covering layer being different from the second color of the outer surface of the rear covering layer.

14. An antenna assembly as defined by claim 13, which further comprises:

an antenna cable connection housing having a front section and a rear section which mates with the front section of the antenna cable connection housing, the front section of the antenna cable connection housing being disposed on a portion of the front covering layer, and the rear section of the antenna cable connection housing being disposed on a portion of the rear covering layer;

wherein the front section of the antenna cable connection housing has a color which is the same as the first color of the outer surface of the front covering layer, and the rear section of the antenna cable connection housing has a color which is the same as the second color of the rear covering layer.

15. A broadband low profile planar wire antenna, which comprises:

an inverted triangular section having outer sloping sides and an apex at least partially defined by the outer sloping sides, the inverted triangular section having an interior area;

an elongated bar section centered in proximity to the apex of the inverted triangular section, the elongated bar section being formed as an elongated member having a first axial end and a second axial end situated opposite the first axial end; and a center-fed reflector, the center-fed reflector being formed as an elongated member and having a first axial end and a second axial end situated opposite the first axial end, the center-fed reflector being situated in proximity to the inverted triangular section opposite the apex thereof and outside the interior area of the inverted triangular section;

wherein the inverted triangular section, elongated bar section and center-fed reflector include, as antenna elements:

a first outer sloping segment and a second outer sloping segment, the first and second outer sloping segments defining the outer sloping sides of the inverted triangular section, each of the first outer sloping segment and the second outer sloping segment being an elongated member and having a proximate end and a distal end situated axially opposite the proximate end of the respective first and second outer sloping segments, the first and second outer sloping segments mutually converging in a direction toward the proximate ends thereof such that the proximate ends of the first and second outer sloping segments are electrically coupled together at the apex of the inverted triangular section;

a first side segment and a second side segment, the first side segment being disposed in parallel with the second side segment, each of the first side segment and the second side segment being an elongated member and having a first axial end and a second axial end situated opposite the first axial end of the respective first and second side segments, the first axial end of the first side segment being electrically coupled to the distal end of the first outer sloping segment, and the first axial end of the second side segment being electrically coupled to the distal end of the second outer sloping segment;

a base segment, the base segment being situated on the inverted triangular section opposite the apex of the inverted triangular section, the base segment being an elongated member and having a center portion, a first axial end and a second axial end situated opposite the first axial end of the base segment, the first axial end of the base segment being electrically coupled to the second axial end of the first side segment, and the opposite second axial end of the base segment being electrically coupled to the second axial end of the second side segment, whereby the second axial end of the first side segment and the first axial end of the base segment together define a first corner of the inverted triangular section of the antenna, and whereby the second axial end of the second side segment and the second axial end of the base segment together define a second corner of the inverted triangular section of the antenna;

a center segment, the center segment being an elongated member and having a proximate end and an extended distal end portion situated axially opposite the proximate end of the center segment, the center segment being disposed at least partially within the interior area of the inverted triangular section and extending from the apex of the inverted triangular section to the base segment, the extended distal end portion extending outwardly from the base segment in a direction away from the apex, the proximate end of the center segment being electrically coupled to the proximate ends of the first and second outer sloping segments at the apex of the inverted triangular section, and the center segment being electrically coupled to the center portion of the base segment near the extended distal end portion thereof;

a first interior angled segment and a second interior angled segment, the first interior angled segment being disposed within the interior area of the inverted triangular section between the first outer sloping segment and the center segment, and the second interior angled segment being disposed within the interior area of the inverted triangular section between the second outer sloping segment and the center segment, each of the first interior angled segment and the second interior angled segment being an elongated member and having a proximate end and a distal end situated axially opposite the proximate end of the respective first and second interior angled segments, each of the first interior angled segment and the second interior angled segment extending between the apex of the inverted triangular section and the base segment, the proximate ends of the first interior angled segment and the second interior angled segment being electrically coupled to the proximate ends of the first outer sloping segment, the second outer sloping segment and the center segment at the apex of the inverted triangular section, the distal end of the first interior angled segment being electrically coupled to the first axial end of the base segment near or at the first corner of the inverted triangular section, and the distal end of the second interior angled segment being electrically coupled to the second axial end of the base segment near or at the second corner of the inverted triangular section;

a first tab segment and a second tab segment, the first tab segment being electrically coupled to the center-fed reflector at or near the first axial end thereof and being situated in proximity to the first corner of the inverted triangular section and extending angularly outwardly from the center-fed reflector to define with the center-fed reflector a first angle, the second tab segment being electrically coupled to the center-fed reflector at or near the second axial end thereof and being situated in proximity to the second corner of the inverted triangular section and extending angularly outwardly from the center-fed reflector to define with the center-fed reflector a second angle; and a third tab segment and a fourth tab segment, the third tab segment being electrically coupled to the center-fed reflector at or near the first axial end thereof and extending angularly outwardly from or near the first axial end of the center-fed reflector away from the inverted triangular section and in an opposite direction from which the first tab segment extends and defining with the center-fed reflector a third acute angle, the fourth tab segment being electrically coupled to the center-fed reflector at or near the second axial end thereof and extending angularly outwardly from or near the second axial end of the center-fed reflector away from the inverted triangular section and in an opposite direction from which the second tab segment extends and defining with the center-fed reflector a fourth acute angle.

16. An antenna assembly, which comprises:

an antenna as defined by claim 15; and a thin front covering layer and a thin rear covering layer, the antenna being situated between the front covering layer and the rear covering layer, the front covering layer having an outer surface, and the rear covering layer having an outer surface, the outer surface of the front covering layer facing away from the outer surface of the rear covering layer.

17. An antenna assembly as defined by claim 16, wherein the overall thickness of the antenna assembly, measured between the outer surface of the front covering layer and the outer surface of the rear covering layer, is less than about one millimeter.

18. An antenna assembly as defined by claim 16, wherein the front covering layer includes a film which supports the antenna, and wherein the rear covering layer is a layer of paint.

19. An antenna assembly as defined by claim 16, wherein the outer surface of the front covering layer is formed with a first color, and the outer surface of the rear covering layer is formed with a second color, the first color of the outer surface of the front covering layer being different from the second color of the outer surface of the rear covering layer.

20. An antenna assembly as defined by claim 19, which further comprises:

an antenna cable connection housing having a front section and a rear section which mates with the front section of the antenna cable connection housing, the front section of the antenna cable connection housing being disposed on a portion of the front covering layer, and the rear section of the antenna cable connection housing being disposed on a portion of the rear covering layer;

wherein the front section of the antenna cable connection housing has a color which is the same as the first color of the outer surface of the front covering layer, and the rear section of the antenna cable connection housing has a color which is the same as the second color of the rear covering layer.

* * * * *